US005755335A

United States Patent [19]

Michelotti et al.

[11] Patent Number: 5,755,335

[45] Date of Patent: May 26, 1998

[54] APPARATUS AND METHOD FOR CENTRALIZED INDEXED INSPECTION AND REJECTION OF PRODUCTS

[75] Inventors: John Michelotti, Greenwich; Ken P. Berlingo, Stamford; Brian P. Romano, Terryville; Brian E. Schwerkolt, New Milford, all of Conn.

[73] Assignee: Steinmetz Machine Works, Inc., Stamford, Conn.

[21] Appl. No.: 507,803

[22] Filed: Jul. 26, 1995

[51] Int. Cl.[6] ..... B07C 5/00

[52] U.S. Cl. ..... 209/528; 209/914; 198/394

[58] Field of Search ..... 209/528, 538, 209/545, 540, 921, 914, 905; 198/346.2, 394

[56] References Cited

U.S. PATENT DOCUMENTS

| | | | |
|---|---|---|---|
| 2,800,226 | 7/1957 | Drennan . | |
| 3,218,463 | 11/1965 | Calhoun . | |
| 3,313,409 | 4/1967 | Johnson | 209/538 X |
| 3,410,388 | 11/1968 | Hendrickson et al. | 209/538 X |
| 3,563,379 | 2/1971 | Stapf et al. . | |
| 3,579,911 | 5/1971 | Steinmetz . | |
| 3,613,885 | 10/1971 | Rehse et al. | 209/528 |
| 3,651,937 | 3/1972 | Kronseder | 209/914 X |
| 3,662,181 | 5/1972 | Hercher et al. . | |
| 3,749,923 | 7/1973 | Husome . | |
| 4,009,772 | 3/1977 | Glaser et al. . | |
| 4,044,227 | 8/1977 | Holm et al. . | |
| 4,074,130 | 2/1978 | Messman et al. . | |
| 4,172,524 | 10/1979 | Holm et al. . | |
| 4,196,224 | 4/1980 | Falk . | |
| 4,280,612 | 7/1981 | Nagano | 198/394 X |
| 4,428,474 | 1/1984 | Gau et al. | 198/394 |
| 4,509,081 | 4/1985 | Peyton et al. . | |
| 4,553,838 | 11/1985 | Madsen . | |
| 4,579,227 | 4/1986 | Miller | 209/538 X |
| 4,591,697 | 5/1986 | Lexer . | |
| 4,691,231 | 9/1987 | Fitzmorris et al. . | |
| 4,707,251 | 11/1987 | Jenkins et al. . | |
| 4,852,415 | 8/1989 | Bogatzki et al. . | |
| 4,859,863 | 8/1989 | Schrader et al. . | |
| 4,915,237 | 4/1990 | Chang et al. . | |
| 4,919,799 | 4/1990 | Menardi et al. . | |
| 4,956,560 | 9/1990 | Smith, Jr. et al. . | |
| 4,987,768 | 1/1991 | Dimmick et al. . | |
| 4,989,462 | 2/1991 | Davis et al. . | |
| 5,059,031 | 10/1991 | Hamel et al. . | |
| 5,072,127 | 12/1991 | Cochran et al. . | |
| 5,097,216 | 3/1992 | Dimmick, Sr. et al. . | |
| 5,305,391 | 4/1994 | Gomibuchi . | |
| 5,315,108 | 5/1994 | Gross . | |
| 5,388,707 | 2/1995 | Stivison et al. . | |
| 5,409,363 | 4/1995 | Muldoon . | |

OTHER PUBLICATIONS

*Packaging Digest*, Jan. 1984, "Gillette stays on the ball" Solution by Machine Development Company, Inc., pp. 1–4.

*Primary Examiner*—D. Glenn Dayoan

*Attorney, Agent, or Firm*—Ware, Fressola, Van Der Sluys & Adolphson LLP

[57] ABSTRACT

The invention provides a method of and apparatus for inspecting a label applied to a container. The method includes the steps of placing the container on a rotatable platform; rotating the platform; detecting an edge of the label as the container rotates on the rotating platform; stopping rotation of the platform at a predetermined position relative to the position of the detected edge of the label; advancing the container to a label inspection station; viewing the label using a machine vision label inspection system; comparing an image obtained by the machine vision inspection system with established criteria to determine if the label meets predetermined standards for the label; and selectively directing the container to a reject outlet if the label does not match the predetermined standards for the label.

13 Claims, 23 Drawing Sheets

SLOT 1
+24VDC
RET
50
51
CAMCO ENCODER
A
B
D
1746-ITV16
24VDC FAST RESPONSE SOURCING
100
IN0
CAMCO CAM SWITCH
101
IN1
LOW LEVEL EYE
102
IN2
BOTTLE PRESENT EYE
103
IN3
NO CAP EYE
104
IN4
105
IN5
106
IN6
107
IN7
VDC
50
51
1746-ITV16
24VDC FAST RESPONSE SOURCING
108
IN8
109
IN9
110
IN10
VACUUM LINE SWITCH
111
IN11
SAFETY GATE HOME
112
IN12
SAFETY GATE EXTEND
113
IN13
114
IN14
115
IN15
VDC
50
51

SLOT 2
+24VDC
RET
50
51
1746-IV16
24VDC SOURCING INPUT
REJECT VERIFY EYE
200
IN0
OUTSERT BAR CODE
201
IN1
SPARE
202
IN2
DISCHARGE
BACKUP EYE
203
IN3
CV1M READY
204
IN4
RESULTS CAMERA 1
205
IN5
RESULTS CAMERA 2
206
IN6
RESULTS CAMERA 3
207
IN7
VDC
TO CVIM2 I/O
(1249CVIM)
50
51
1746-IV16
24VDC SOURCING INPUT
RESULTS CAMERA 4
208
IN8
209
IN9
210
IN10
211
IN11
SPARE
212
IN12
213
IN13
214
IN14
215
IN15
VDC
50
51

SLOT 3
+24VDC
50
RET
51
GALIL SERVO OUTPUTS
OP0
OP1
OP2
OP3
OP4
OP5
EDGE FOUND
1746-IV16
24VDC SOURCING INPUT
300
301
302
303
304
305
306
307
IN0
IN1
IN2
IN3
IN4
IN5
IN6
IN7
VDC
50
51
1746-IV16
24VDC SOURCING INPUT
308
309
310
311
312
313
314
315
IN8
IN9
IN10
IN11
IN12
IN13
IN14
IN15
SPARE
VDC
50
51

APPARATUS AND METHOD FOR CENTRALIZED INDEXED INSPECTION AND REJECTION OF PRODUCTS

BACKGROUND OF THE INVENTION

1. Field of the Invention

This invention relates to an apparatus and method for centralized indexed inspection and rejection of products and containers; and more particularly, for centralized indexed positioning of pharmaceutical containers for inspection of labels thereon and rejection of improperly labelled containers.

2. Background of the Invention

In the pharmaceutical industry, the Food and Drug Administration (FDA) requires that pharmaceutical companies perform diligent inspections on all packaging labels and outserts. Inspections are also required on some product containers. The inspections are required to confirm that a product is packaged with the correct labels, outserts, etc. In addition, various product volume inspections are done during packaging.

In the prior art, there are two known ways for inspection. The first inspection method is to have two people at each inspection area manually visually inspect each container for each requirement, thereby meeting the FDA requirement of 200% manual inspection. The second method is to automatically perform the inspections. This method uses vision systems that perform optical character verification (OCV). Such OCV systems are computer based and are composed of cameras, lights and computers. There are also readers for bar codes or data matrix codes. These readers typically are supplied with decoders.

For example, one such inspection system has an OCV device for first inspecting a web of labels prior to the application of the labels to containers. After inspection, all labels, both acceptable and unacceptable, are then applied to filled containers, but any containers with unacceptable labels are rejected from the line at a later station. The inspection system also has a separate rejection station for rejecting bad containers. The reject stations are mechanical in nature and are often displaced from the actual inspection area. Timing or piece counts are relied on to reject improper containers. Such systems are not always reliable because when the timing or piece count is not correct, the rejection station may reject properly labelled containers and may not reject improperly labelled containers. Moreover, the problem is compounded because normally there are multiple reject stations on a packaging line, each being controlled by one or more inspection stations.

Therefore, the known method of inspections and rejections using cameras, readers, etc. on existing equipment is a totally decentralized system, which suffers from some very important disadvantages, including: (1) The prior art system is very costly to develop, install, maintain and train people to use; (2) The prior art system must be customized to each particular application; (3) The prior art system only checks separate components, not finished products; (4) In the prior art system, each piece of equipment that is modified must be revalidated which is very time-consuming and costly to the pharmaceutical manufacturer; (5) The prior art system requires longer product changeover times; (6) The prior art system requires more parts, which are more prone to breakdown; (7) The prior art system does not provide coordinated inspection and rejection; (8) The prior art system results in extended production downtime while being installed and validated.

Furthermore, U.S. Pat. No. 3,613,885 teaches another method known in the art to perform tests as to whether or not a label is applied to a pharmaceutical container, but this system does not allow for any determination as to the quality of the label, i.e., whether a correct label has been applied. It only determines the presence or absence of a label.

Moreover, in the consumer beverage industry, Menardi et al. (U.S. Pat. No. 4,919,799) teaches a device for sorting beverage cans 16 having trigger indicia 48 and code indicia 28 thereon. As described in Menardi et al., on column 10, line 62, through column 11, line 34, the trigger indicia 48 is the only indicia provided in a circumferential path 128, is positioned at a circumferential location with respect to the code indicia 28, and may consist of a dark line on a light background or a light line on a dark background. As shown in FIGS. 1–4, the sorting device pneumatically retains each beverage can 16 on a spinning head unit 120, continuously spins each beverage can 16 with spinning means 44, senses the trigger indicia 48 with trigger indicia sensing means 46, actuates an illuminating device such as a strobe 51 with a read actuation means 54 for providing illuminated code indicia, reads the illuminated code indicia 28 with a camera 50 of code indicia reading means 52 for providing a code indicia image, compares the code indicia image with a predetermined comparison criteria in comparison means 56, and rejects unacceptable beverage cans with an object segregation means 58 having a blow-off nozzle 170. In particular, as described in Menardi et al., on column 9, lines 35–36, the spinning head 120 spins continuously at a predetermined rate during operation of the system. The read actuation means 54 responds to a trigger signal from the trigger means 46 for actuating the code indicia reading means 52 for a short period during the continuous spinning of the beverage can 16 at a time when the code indicia 28 is positioned in a readable relationship with the camera 50 of the code indicia reading means 52, as described in Menardi et al., on column 12, lines 5–27.

SUMMARY OF THE INVENTION

The invention provides a centralized indexed apparatus and method for positioning containers for inspection and rejection. The apparatus includes indexed multi-container positioning means and centralized multi-container positioning control means. The indexed multi-container positioning means responds to multiple containers, for providing indexed multi-container positioning information signals to the centralized multi-container positioning control means, and further responsive to centralized multi-container positioning control signals from the centralized multi-container positioning control means, for providing indexed accepted or rejected positioned containers. The centralized multi-container positioning control means responds to the indexed multi-container positioning information signals from the indexed multi-container positioning means, for providing the centralized multi-container positioning control signals to the indexed multi-container positioning means.

In one embodiment of the invention, the indexed multi-container positioning means is rotatably indexed. Moreover, the centralized multi-container positioning control means includes a programmable logic controller (PLC) means for providing centralized intelligence to control the positioning of multiple containers for inspection.

The centralized indexed apparatus and method for positioning containers for inspection and rejection provides important advantages over the prior art systems discussed above, including: (1) It performs inspection on a finished product; (2) It maintains positive control of the product at all times to assure bad products are rejected; (3) It requires no modification or reprogramming of existing production equipment; (4) It enables all inspection functions to be tested prior to on-line installation; (5) It performs all required inspections in one central location; (6) It enables most installation and operational qualification (validation) to be done off-line; (7) It allows operator training to be done off-line; and (8) It minimizes production downtime for installation, validation, maintenance, and personnel training.

Other objects, aspects and features of the present invention in addition to those mentioned above will be pointed out in or will be understood from the following detailed description provided in conjunction with the accompanying drawings.

BRIEF DESCRIPTION OF THE DRAWING

The present invention may be more clearly understood from the following description of a specific and preferred embodiment read in conjunction with the accompanying schematic and detailed drawings, wherein.

Figure 1:
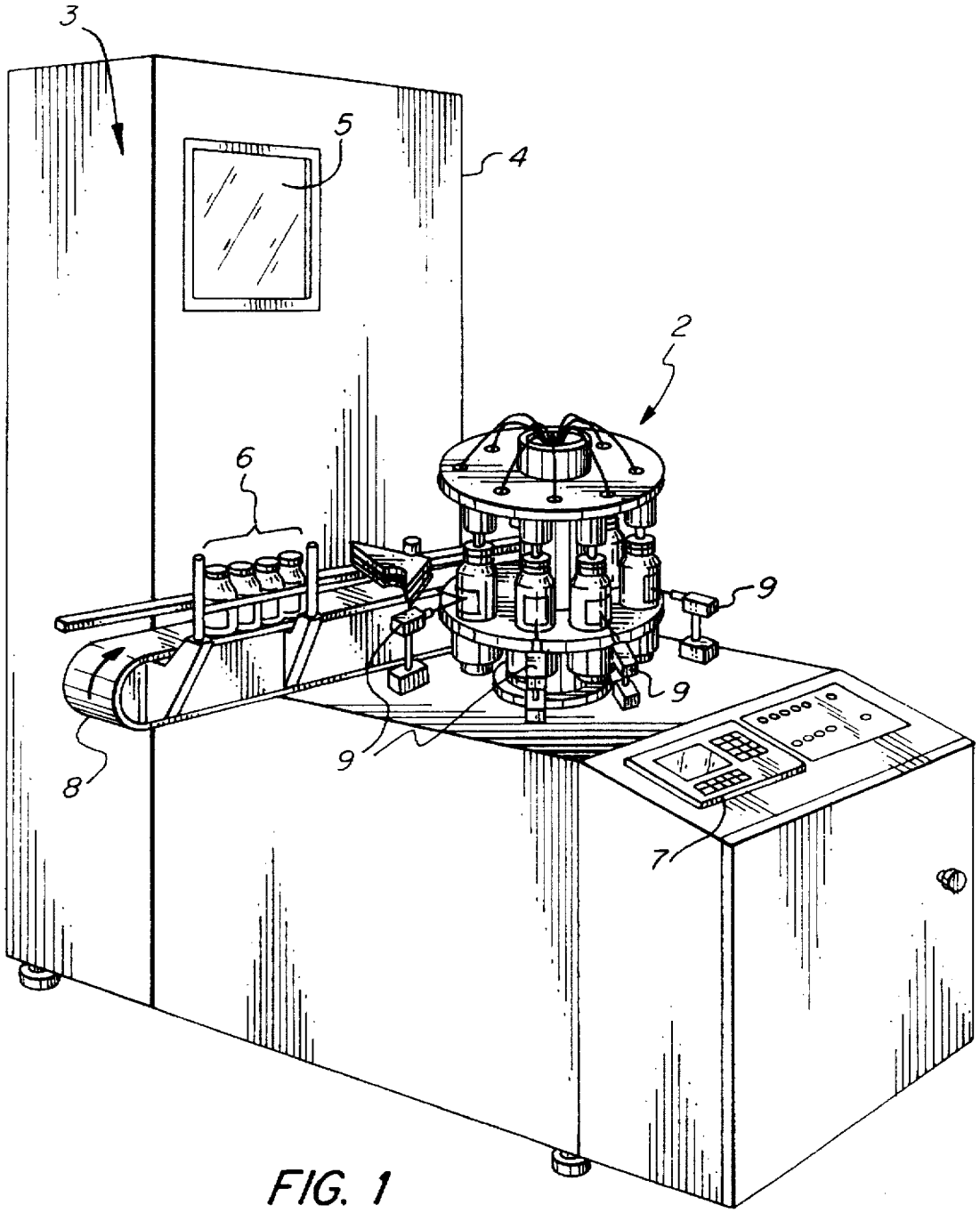
FIG. 1 is a perspective view of a sketch of the present invention.

It should be understood that FIGS. 1–17 of the drawing are not necessarily to exact scale and that certain aspects of the embodiments may be emphasized for clarity of the invention. Actual embodiments or installations thereof may differ depending upon the particular location or application for which the apparatus is designed.

DESCRIPTION OF THE BEST MODE OF THE INVENTION

Centralized Indexed Multi-Container Positioning

As shown in FIG. 1, the invention provides a centralized indexed apparatus for positioning containers for inspection and has an indexed multi-container positioning means 2 shown in detail in FIGS. 2–10, and centralized multi-container positioning control means that is arranged inside a main electrical cabinet 4, and that is generally indicated as 3 and shown in detail in the circuit diagrams in FIGS. 11–17.

In the broadest sense of the invention, the indexed multi-container positioning means 2 responds to multiple containers generally indicated as 6 moving along a conveyor belt means generally indicated as 8, for providing indexed multi-container positioning information signals to the centralized multi-container positioning control means 3 inside the main electrical cabinet 4, as will be discussed in detail below. In addition, the indexed multi-container positioning means 2 also responds to centralized multi-container positioning control signals from the centralized multi-container positioning control means 3, as also discussed in detail below, for providing indexed accepted or rejected positioned containers, which are not shown in FIG. 1. As discussed below, the indexed multi-container positioning information signals generally include inspection information about the multiply positioned containers being inspected, such as inspection information about label indicia, and generally indicates whether the multiply positioned containers pass or fail various inspections. Furthermore, the centralized multi-container positioning means 3 responds to the indexed multi-container positioning information signals, for providing the centralized multi-container positioning control signals, which control the operation of the indexed multi-container positioning means 2.

In the preferred embodiment of the invention, the indexed multi-container positioning means 2 is rotatably indexed for rotatably positioning containers for inspection in view of one or more different container inspection means, generally indicated as 9. Moreover, the centralized multi-container positioning control means 3 arranged inside a main electrical cabinet 4 includes a programmable logic controller (PLC) shown in detail in FIGS. 11–17, having a microprocessor controller means for providing centralized positioning intelligence to operate the apparatus, and having a memory means for storing an applications control program for operating the indexed multi-container positioning means 2.

Label Inspection Station

Figure 2:
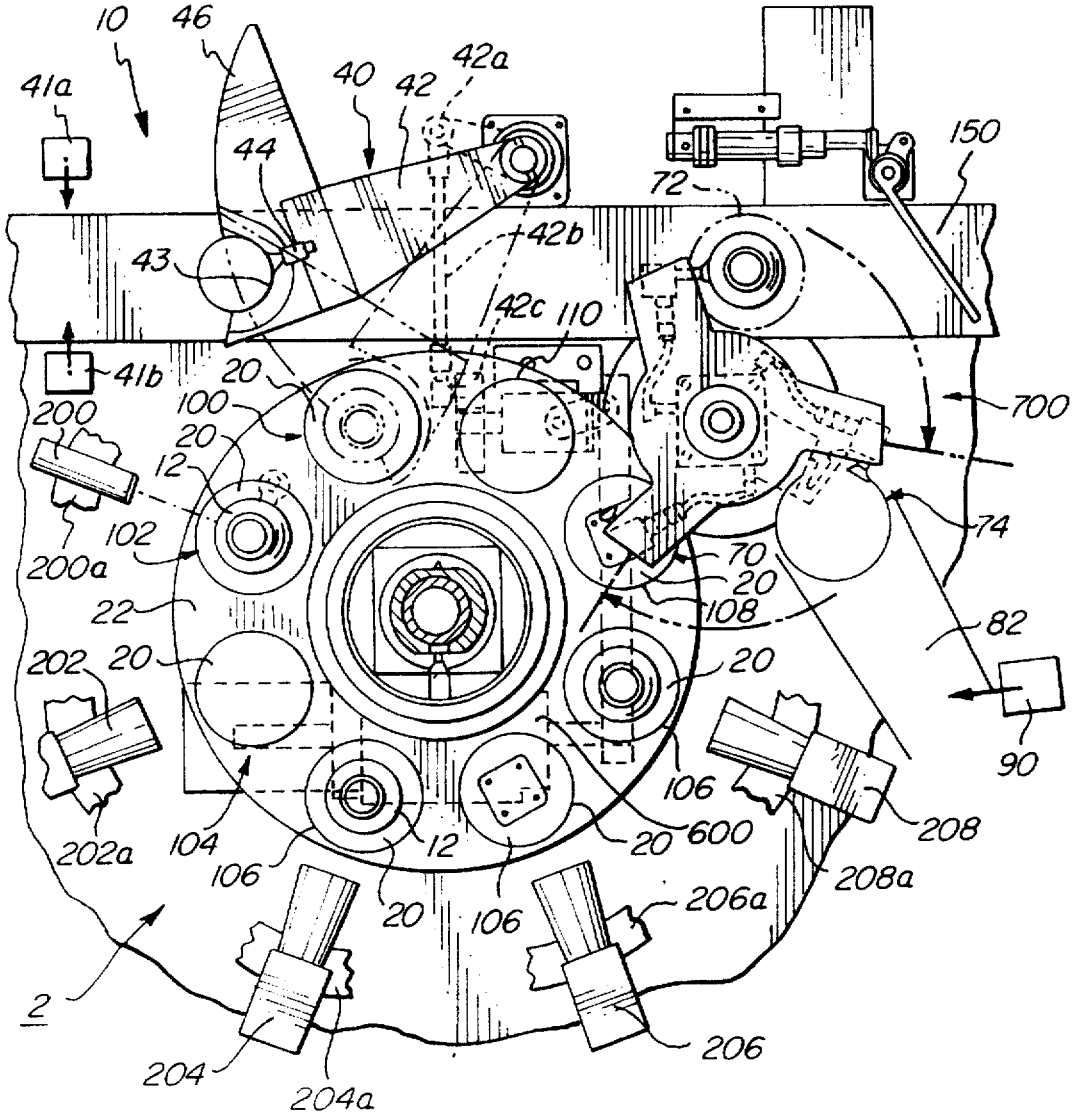
FIG. 2 is a top assembly view of the present invention.

In one particular embodiment, as shown in FIG. 2, the invention is used in a label inspection device generally indicated as 10 for positioning pharmaceutical containers 12 to inspect for label indicia on labels 14.

Figure 3:
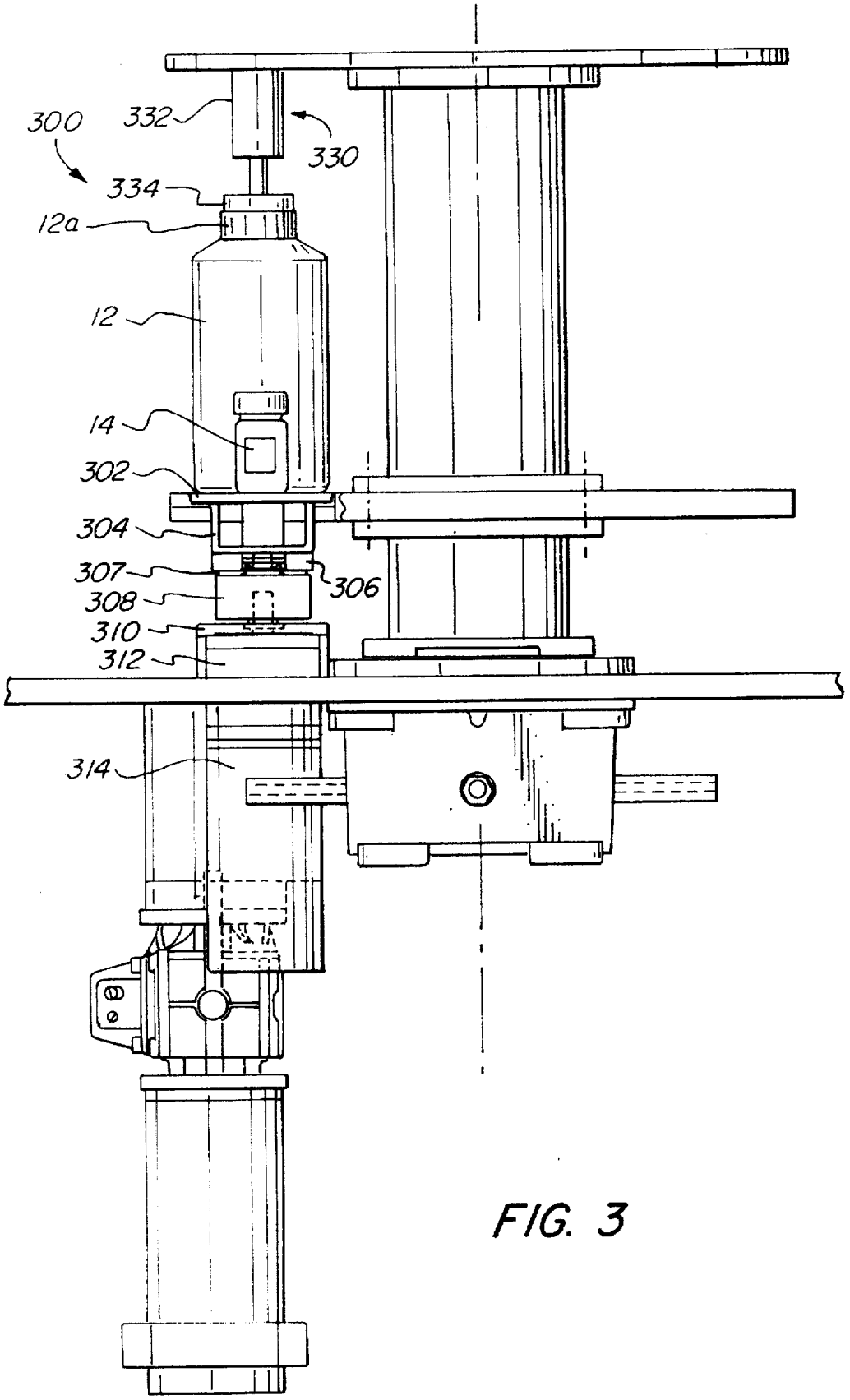
FIG. 3 is a side view of a spin assembly station.
Figure 4:
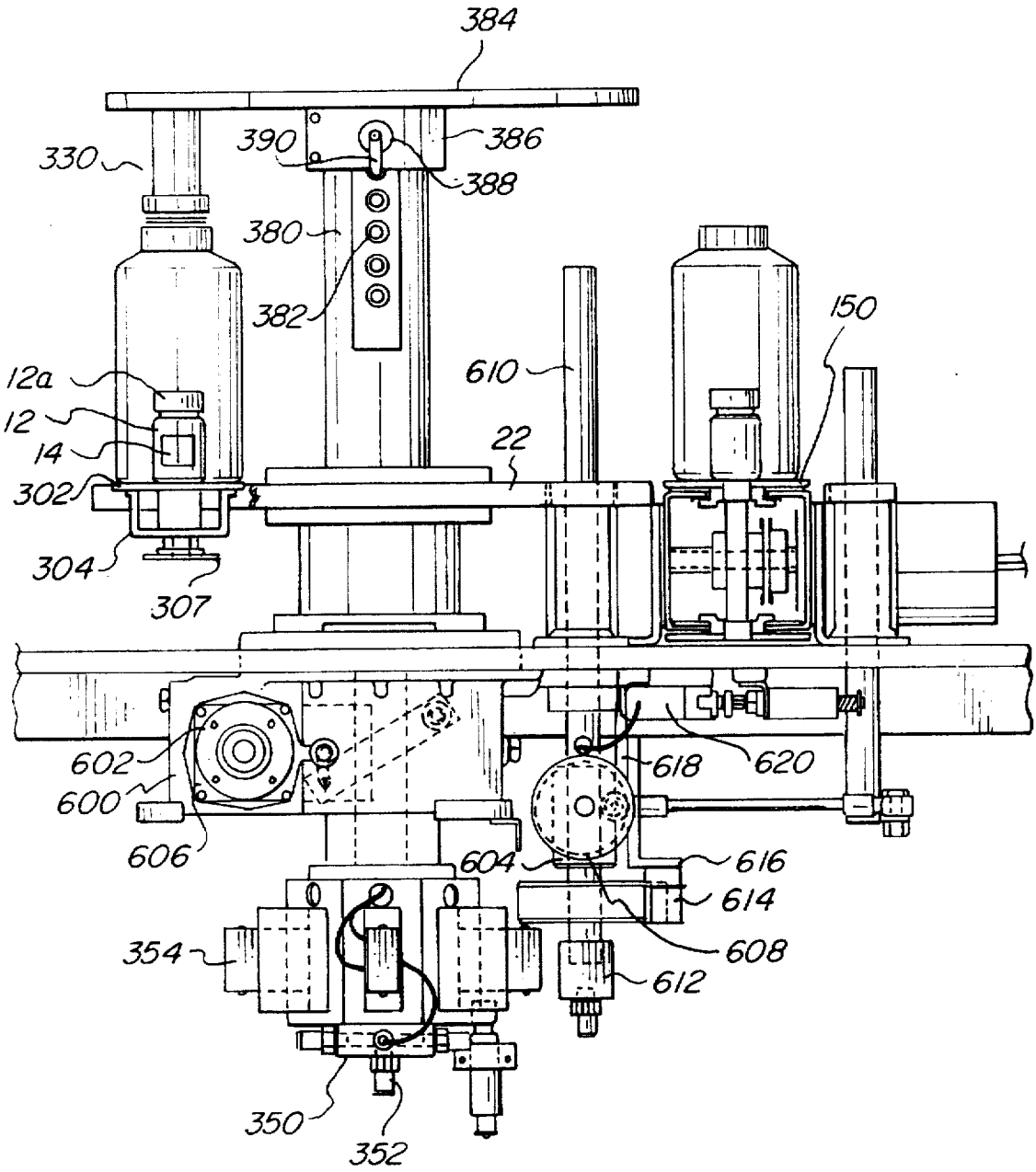
FIG. 4 is a side assembly view of the present invention.

In FIGS. 2–4, the label inspection device 10 has a conveyor means 8 (FIG. 1) also generally indicated as 150 in FIGS. 2 and 4 for providing containers to and from the indexed multi-container positioning means 2. The indexed multi-container positioning means 2 of the label inspection device 10 has a rotatable dial plate 22 having eight rotatable platens 20 arranged therein and being rotatably movable through a plurality of index inspection stations generally indicated as 102, 104, 106, 108, etc. The label inspection device 10 has inspection means generally indicated as 200, 202, 204, 206, 208 for viewing various indicia on the label 14 as it moves around the indexed multi-container positioning means 2. The scope of the invention is not intended to be limited to the type of inspection means or the type of inspection. The indexed multi-container positioning means 2 also has an adjustable container in-feed loader assembly generally indicated as 40 for placing containers 12 on the rotatable dial plate 22, and an adjustable rotating escapement assembly generally indicated as 700 for selectively providing either an accepted container to an accept outlet 80 or a rejected container to a reject outlet 82, shown in FIG. 2. A detailed description of these elements and their operation will follow.

Conveyor Assembly 150

Figure 5A:
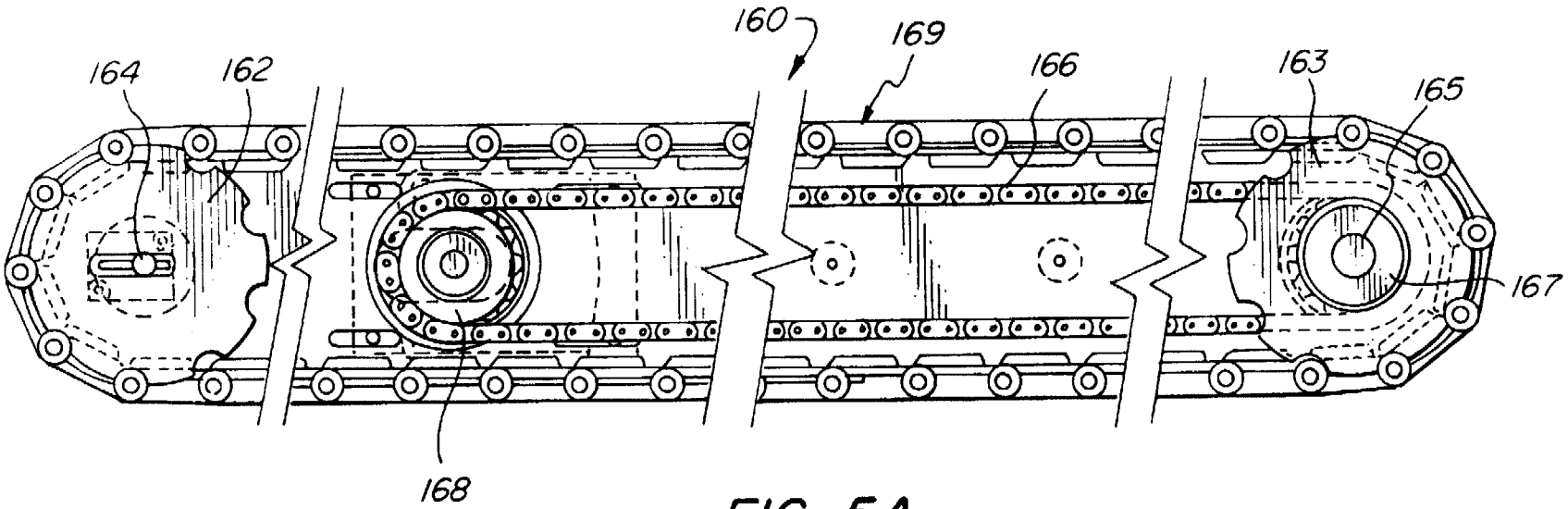
FIG. 5A is a side view of a conveyor belt.
Figure 5B:
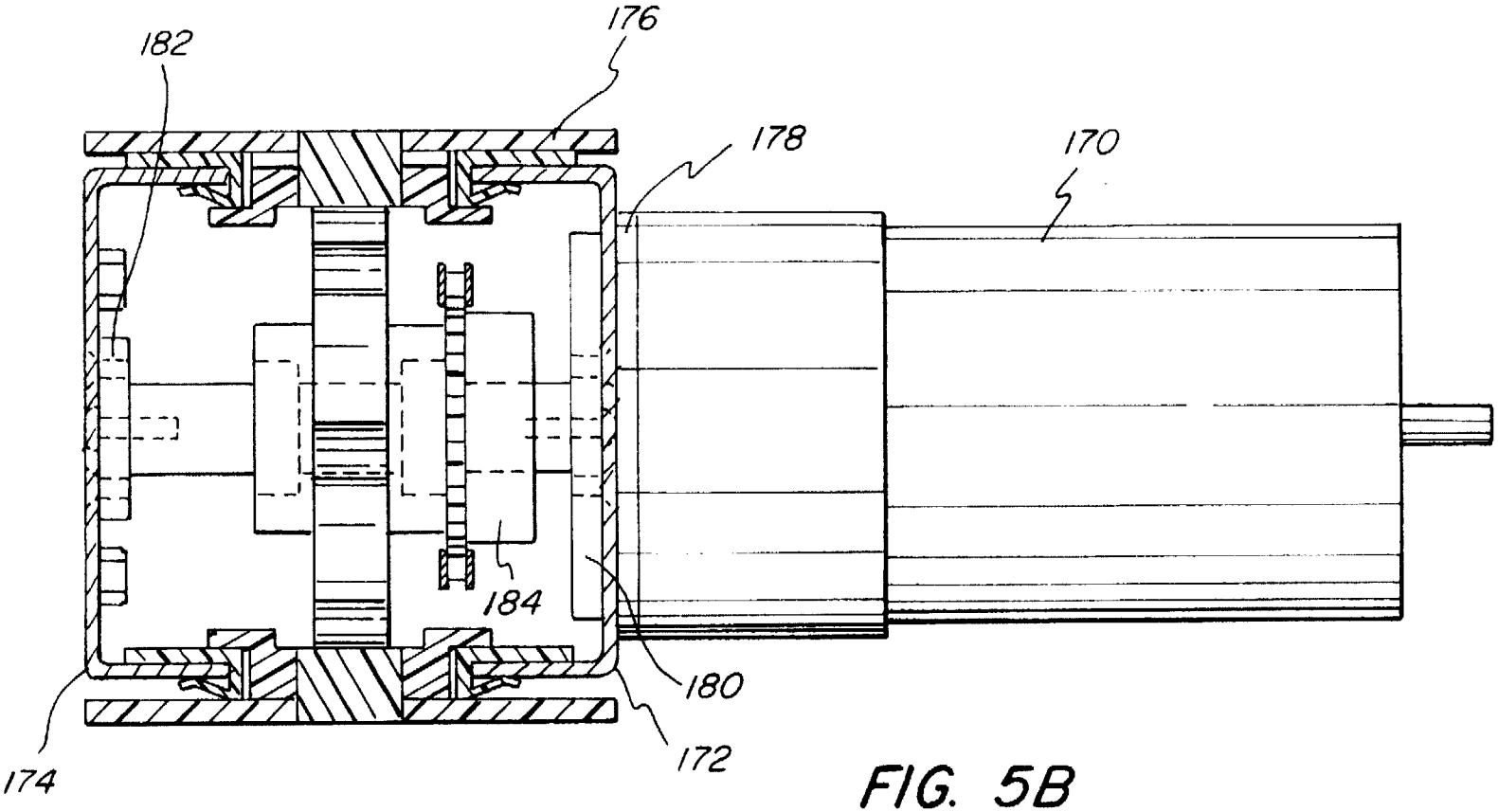
FIG. 5B is a cross-sectional view of a conveyor belt motor for driving the conveyor belt assembly in FIG. 5A.

FIGS. 5A and 5B show the conveyor assembly 150. FIG. 5A shows a conveyor belt means generally indicated as 160 and FIG. 5B shows a Grainger motor means generally indicated as 170, both of which are known in the art.

The conveyor belt 160 includes two sprockets 162, 163, two axles 164, 165, a roller chain 166, two rollers 167, 168, and a conveyor belt 169.

The Grainger motor 170 includes a side motor mount plate 172, a side conveyor plate 174, a conveyor chain 176, a conveyor motor mount plate 178, a motor mount plate 180, a chain adjuster 182, and a bore sprocket 184.

The scope of the invention is not intended to be limited by the type of conveyor assembly used to provide containers to and from the indexed multi-container positioning means 2.

Adjustable Container In-feed Loader Assembly

As shown in FIG. 2, the adjustable container in-feed loader assembly 40 has a pivotally mounted loading arm 42 having a container in-feed assembly including a container nesting pocket 43, a vacuum cup 44, and a container blocking flange 46. The container nesting pocket 43 receives the container from the conveyor assembly 150, is contoured to the shape of the container, and can be manually changed to adapt the adjustable container in-feed loader assembly 40 to a different container. The vacuum cup 44 stops and grips the container 12 moving along the conveyor assembly 150. The loading arm 42 is pivotally movable between a container receiving position where it receives a container 12 from the conveyor line 26 and a container delivering position shown in phantom in FIG. 2 where it delivers a container 12 to the indexed multi-container positioning means 2 shown in phantom in FIG. 2. The container delivering position is located at and is coincident with a first indexed inspection station 100 of the rotating dial plate 22. The container blocking flange 46 prevents the advance of containers 12 on the conveyor assembly 150 when the loading arm 42 is delivering a container 12 to the first indexed inspection station.

FIG. 2 also shows that the pivotally mounted loader arm 42 has a load arm assembly linkage with a female rod end 42*a*, a link arm 42*b*, and timing adjustment plates 42*c*, for connecting the pivotally mounted load arm 42 to an indexer, motor/reducer, clutch brake means generally shown in phantom and indicated as 600 that rotates the indexed multi-container assembly means 2. The load arm assembly linkage for driving the adjustable container in-feed loader assembly 40 with the indexer, motor/reducer, clutch brake means 600 is also shown in phantom in FIG. 2.

Figure 8:
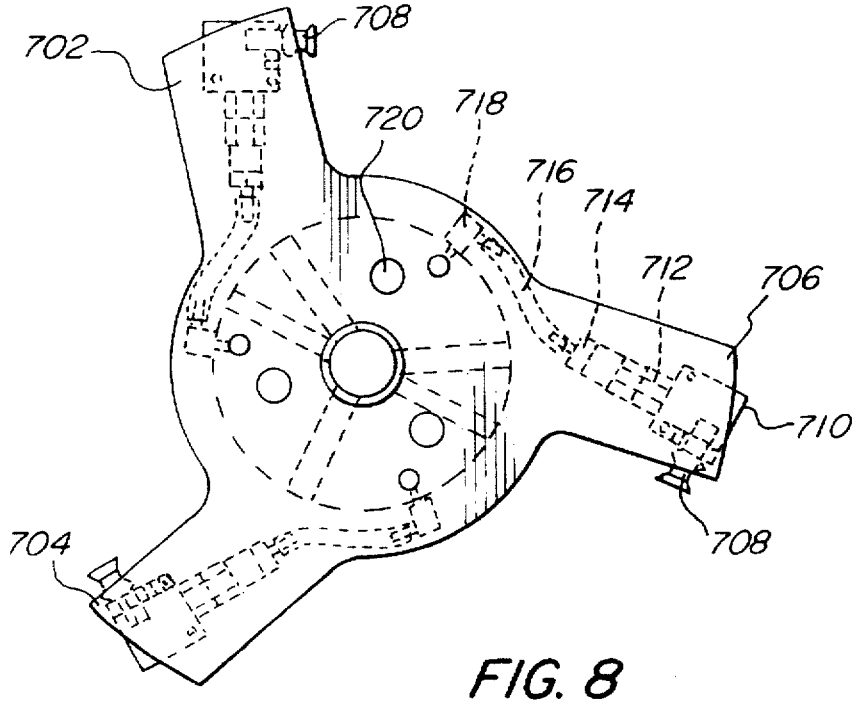
FIG. 8 is a top down view of one side of the stackable escapement plates in the escapement assembly in FIG. 7.
Figure 9:
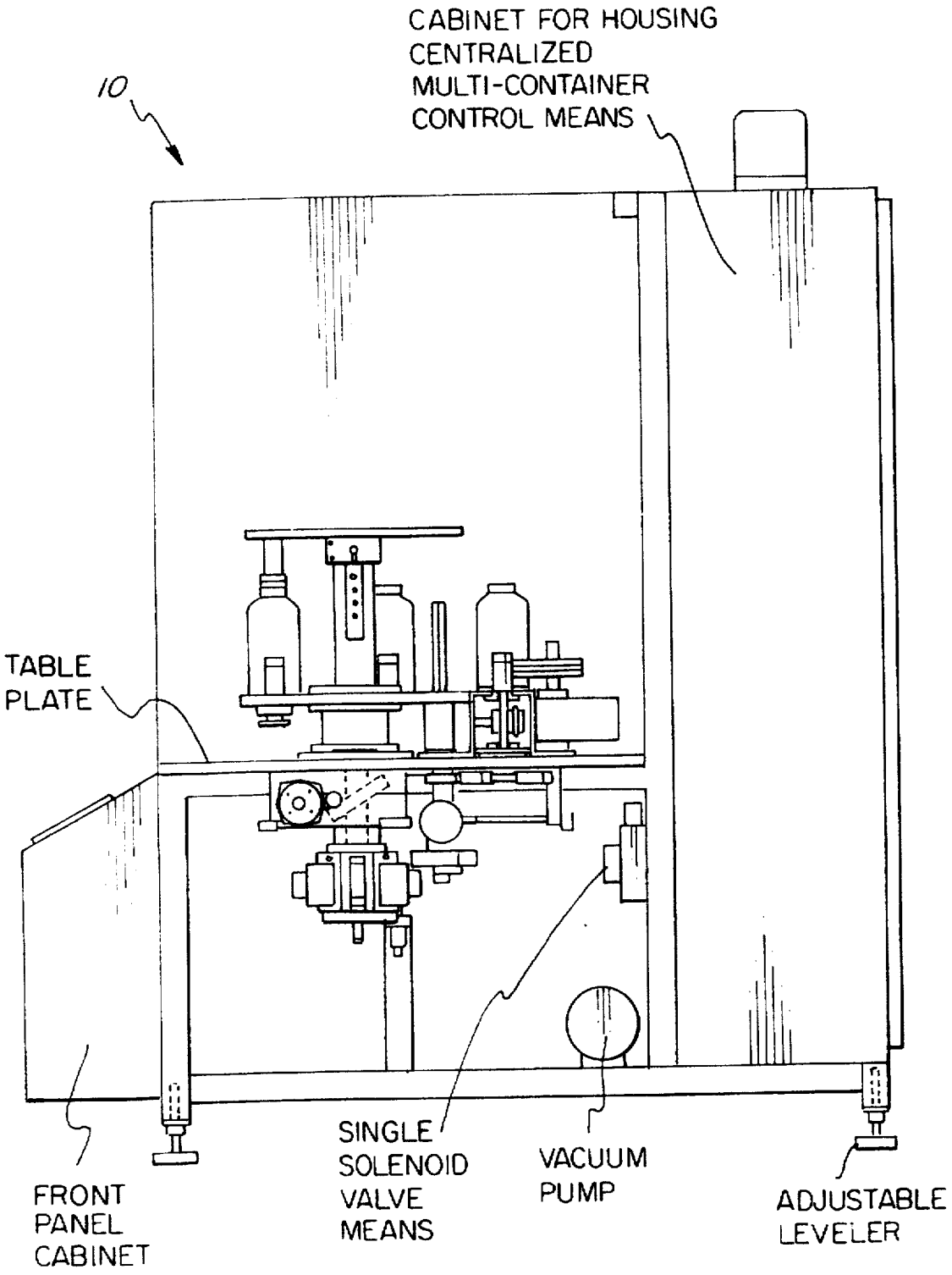
FIG. 9 is a side view of the present invention.

The adjustable container in-feed loader assembly 40 also includes a vacuum assembly for providing vacuum from a main vacuum supply 500 in FIG. 9 to the vacuum suction cup 44 for holding a container during loading. The timing of the suction, and lack thereof, of the vacuum cup 44 is controlled by the centralized multi-container positioning control means 3. These features are all discussed in more detail with respect to the discussion of the escapement assembly 700 in FIGS. 7–8.

Figure 10:
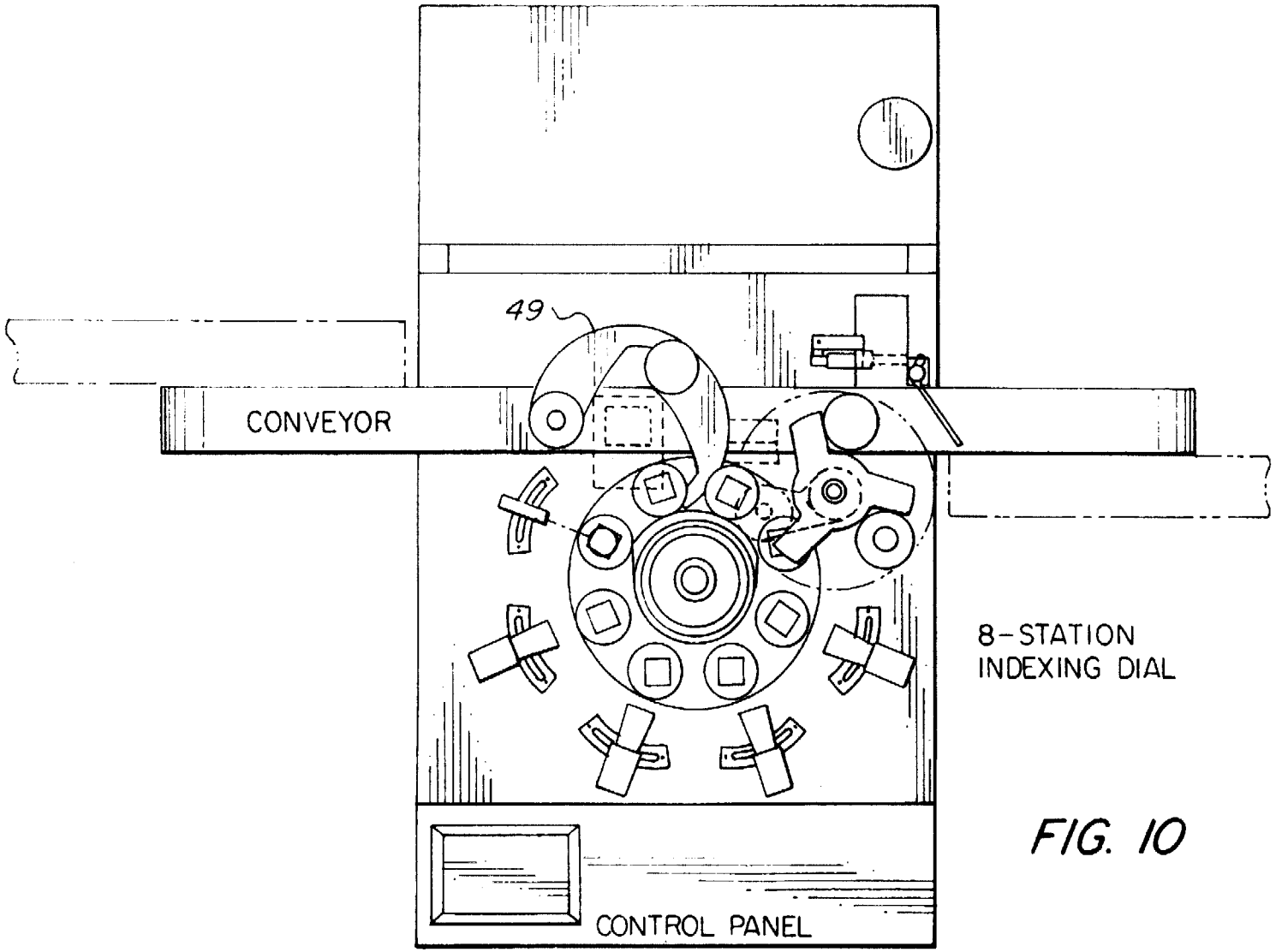
FIG. 10 is an alternative embodiment of an in-feed container load assembly of the present invention.

In an alternative embodiment, the container in-feed loader assembly includes an adjustable star-shaped rotary in-feed 49, as shown in FIG. 10. The adjustable star-shaped rotary in-feed 49 significantly increases the throughput of the inspection device compared to the load arm 42. The adjustable rotary in-feed 49 is adjustable because it consists of a plurality of stackable load plates. The stackability of the load plates is similar in design to escapement plates 740, 742, 744 shown in FIG. 7 and described in detail below. For example, large containers may require 3 or more stackable load plates, while small containers may need only one load plate. In effect, the number of plates is determined by the height of the containers being inspected.

Adjustable Rotatably Indexed Multi-container Positioning Means

The indexed multi-container positioning means 2 is manually adjustable in height and rotatably indexed for positioning for inspecting containers having different label indicia at one time. It includes the rotating dial plate 22 and the indexer, motor/reducer, clutch brake means 600 for continuously turning (i.e. indexing) the rotating dial plate 22. The indexer, motor/reducer, clutch brake means 600 is known in the art and supplied by CAMCO; although the scope of the invention is not intended to be limited to only such a motor. As shown, the indexer, motor/reducer, clutch brake means 600 also include a Browning pulley 602, a gear box 604, idler means 606, a Browning belt 608 and other suitable linkage.

The indexed multi-container positioning means 2 has the eight indexed inspection stations 102, 104, 106, 108, 110, etc. arranged on the rotating dial plate 22, each having a rotatable platen 20 in FIG. 2 and indicated as 302 in FIG. 3 for rotatably supporting the container during label inspection, a bearing cup and a sealed ball bearing generally indicated as 304, to enable low-friction spinning of the container 12, during the initial spinning phase of the inspection to establish orientation. The scope of the invention is not intended to be limited to either the number of indexed inspection stations 102, 104, 106, 108, etc. on the rotary dial plate 22, or the number of indexed inspection stations 102, 104, 106, 108, etc, used during the inspection of labels. As shown in FIG. 2, the rotating dial plate 22 is driven by the indexer, motor/reducer, clutch brake means 600 to move in a fixed pattern of preselected increments so that the containers on the indexed inspection stations 102, 104, 106, 108, etc, move through a series of predetermined inspections by inspection means 202, 204, 206, 208, etc. The containers on the indexed inspection stations 102, 104, 106, 108, are held at each inspection means 200, 202, 204, 206, 208, etc for a predetermined period of time. The rotation increments of the rotating dial plate 22 will be dependent on the number of inspections desired. For example, if there are four indexed inspection stations, then each rotational increment will be a 90 degree turn. In the preferred embodiment shown in the drawings, there are eight indexed inspection stations (although only seven are used) and thus the rotating dial plate 22 will advance (i.e. index) 45 degrees with each rotational increment.

It should be noted that the scope of the invention is not intended to be limited to any particular means for advancing or indexing the rotating dial plate 22. Embodiments are envisioned using linear conveyor system, or other table designs, although such other systems for advancing a container 12 appear to be less efficient and more costly than the embodiment shown and described.

As shown in FIG. 2, one of the eight indexed inspection stations 102 is an indexed spinning inspection station 300, which is best shown in FIG. 3.

During label inspection, the indexed spinning inspection station 300 spins the container 12 on the rotatable platen 20, establishes the orientation of the container 12 depending on indicia sensed on the label 14, or other data, and stops the container 12 from spinning for subsequent testing. Then the rotary dial plate 22 rotates so the container is moved for a subsequent inspection of the label 14. The centralized multi-container positioning control means 3 provides suitable centralized multi-container positioning control signals to effect such rotatably indexed inspections. It is important to note that as shown and described, the scope of the invention is not intended to be limited to only one indexed spinning inspection station 300 like the one shown in FIG. 3.

Moreover, as shown, the indexed spinning inspection station 300 further includes a friction disk 306, a drive disk and a curved drive spring 307, a drive disk and an electric clutch 308, a motor mount plate 310, a gear box 312 and a servo motor 314 for spinning the rotatable platen 302 in FIG. 3, that supports the container 12 during inspection.

In operation, the indexed spinning inspection station spins the container 12 to allow the entire label 14 to be viewed. The servo motor 314 with an electromagnetic clutch engages the rotatable platen 302. The servo motor 314 spins either until it has rotated 400 degrees or until it receives a signal from a UV sensor generally indicated as 200 in FIG. 2, whichever is less. The servo motor 314 stops and the electric clutch is released. It is important to note that the invention is not intended to be limited to label edge inspection with a UV sensor, because the invention is equally applicable to establishing orientation with optical or visual sensing, or with no label edge sensing at all in the case of a square container.

In one embodiment, the centralized multi-container positioning control signals from the centralized multi-container positioning control means 3 include encoder signals that activate the servo motor 314, clutch disengage signals that disengage the servo motor 314, and servo motor spin signals that spin the servo motor 314 for 400 degrees and stop the motor if no signal is received from the UV sensor 200 in FIG. 2. If no signal is received from the UV sensor 200, or other container indicia sensing means, a bad container signal is sent to a shift register in the centralized multi-container positioning control means 3. If the centralized multi-container positioning control means 3 receives three consecutive bad container signals, then it will cause a cycle stop fault. The scope of the invention is not intended to be limited to only these steps of operation.

The indexed multi-container positioning means 2 also includes a corresponding plurality of adjustable container clamping means, one of which is generally indicated as 330 in FIGS. 3–4. (See also FIG. 1, which shows the plurality of container clamping means above the respective containers shown). As shown in FIGS. 3–4, the container clamp 300 includes an air cylinder 332 for extending and retracting a holddown device 334 to clamp the top 12*a* of the container 12 to and from an extended position and a retracted position. As shown in FIGS. 3–4, the container clamp 300 is in the extended position for clamping the container 12. In operation, after the container 12 is loaded from the conveyor means 150 to the rotary dial plate 22, then the holddown 334 of the container clamp 330 clamps down the container. During the inspection of labels of the container, the adjustable container clamp 330 extends the holddown device 334 for all subsequent testing of various other indicia on the label; however, the scope of the invention is not intended to be limited to only such an embodiment. If desired, the holddown 334 may also be solenoids or other reciprocating mechanisms known in the art. The clamping action of the holddown 334 maintains the desired position of each container 12 as the rotary dial plate 22 rotates incrementally to the next rotational position to perform the next inspection, and provides friction between the container and the platen 20 so that the servo motor 314 can spin the container.

As shown in FIG. 4, the indexed multi-container positioning means 2 is connected to the vacuum pump 500 shown in FIG. 9 to provide vacuum pressure, for example, to the adjustable container in-feed loader assembly 40, and the escapement assembly 700, discussed below.

In FIG. 4, the indexed multi-container positioning means 2 also includes a valve manifold 350, a rotary coupling 352, eight manual air valves generally indicated at 354, a value base means 356 and air cylinder valve actuators for actuating one or more of the manual air valves. Each of the eight manual air valves 354 corresponds to a respective one of the adjustable container clamping means. One of the air cylinder valve actuators actuates one adjustable container clamp 300 for extending the holddown device 334 to clamp the top 12*a* of the container 12, and another one of the air cylinder valve actuators actuates another one of the adjustable container clamping means for releasing the holddown device 334 to unclamp the top 12*a* of the container 12 in order to release it from the rotary dial plate 22, as discussed below.

In operation, the clamp air cylinder valve actuator actuates the cylinder to shuttle the clamp cylinder valve. When the clamp cylinder valve actuator receives a signal from the centralized multi-container inspection control 3, this opens up the air to the extend port of the cylinder which extends and physically shuttles the valve.

The adjustable container clamp 300 is manually adjustable for adapting to containers having various heights, as follows. The indexed multi-container positioning means 2 includes a main column 380 having drill bushings 382, a top plate 384 arranged on the main column 380, a top plate clamp 386 with an aperture, a releasable top plate clamp 388 and a spring plunger 390. The releasable top plate clamp 388 is inserted through the aperture (not shown) and into one of the drill bushings 382 for adjusting the height of the indexed multi-container positioning means 2.

In operation during label inspection, as shown in FIG. 2, the rotary dial plate 22 is rotationally incremented for positioning container for inspection by the inspection means 200. As discussed above, the indexed spinning station 300 in FIG. 3 is used to orient the container 12 and label 14 for subsequent inspection. Since the inspection to be performed is preferably an inspection of the entire label 14, it is necessary to properly position the container 12 so that the label 14 can be viewed by a first inspection means such as a machine vision label inspection system 200. Proper orientation is achieved by identifying a label edge detection system and rotationally orienting the container 12 based upon the detected label edge. Such a label edge detection system will detect an indexing marking on the label 14, such as ink or other optical indicia printed along the inner edge of one side of the label 14. Typically, the ink will be a fluorescent ink visible in ultraviolet light, or it can be another ink, such as a magnetic ink, that is easily detected by appropriate detection equipment. As shown in FIG. 3, the servo motor 314 spins the container 12, and the inspection means 200 detects the label edge. When the label edge is detected, the centralized multi-container control means 3 will stop the operation of the servo motor 314, and consequently the rotation of the platen 20, at a desired position to permit subsequent label inspection. It is to be appreciated that the servo motor 314 will not necessarily be immediately stopped upon detection of the label edge, it may instead be controlled to stop a selected number of degrees of rotation after detection of the label edge, for example, 90 or 180 degrees after detection of the label edge. The stop location will be dependent on the desired position of the container 12 for subsequent inspection.

Although it would also be possible to apply a detectable indexing marking to the container 12 and to detect the container marking, this is a less desirable approach as it would require the labels to be applied to the containers 12 in a specific relationship to the container indexing marking so that the label 14 is properly positioned for inspection when such a container indexing marking is detected and platform rotation is stopped. This approach would require additional steps in orienting the container 12 before the label 14 is applied to the container 12, and is thus a less preferable approach to orienting the container 12 and label 14 for label inspection.

Figure 6:
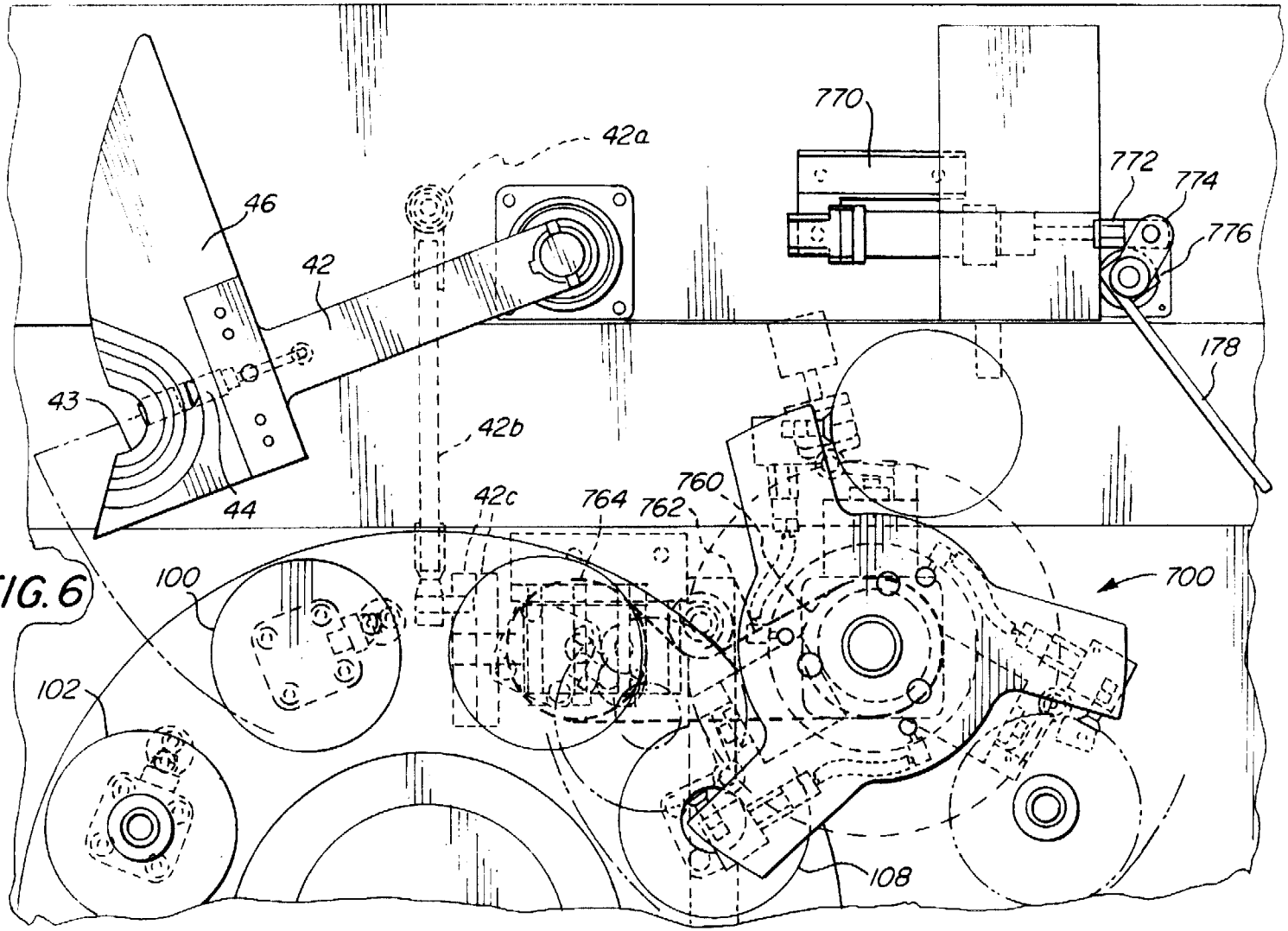
FIG. 6 is a partial top down view of an escapement assembly of the present invention.

After inspecting the container 12 at the second indexed inspection station 102, the rotary dial plate 22 will rotationally advance to a third indexed inspection station 104 where label inspection occurs. The label inspection uses a second inspection means such as a machine vision inspection system 202 to view the label 14 affixed to the container 12. The machine vision inspection system 202 generates an image that is compared with established criteria (such as an image of how the correct label should look) to determine if the label 14 meets predetermined standards for the label. If the label 14 fails such test, then the centralized multi-container control means will generate a reject container signal to the escapement assembly 700, as shown in FIG. 6, which will cause the container 12 to be sent to reject outlet 82.

The scope of the invention is not intended to be limited to the order of inspection. For example, in one embodiment envisioned the orientation step of indexed inspection station 102 may be performed after an initial label inspection, as described above, in connection with indexed inspection station 104, instead of before. In effect, the inspections are reversed. The reversal of the order may be appropriate, for example, if there is a square container, and it is desired to inspect four sides of the container. In such case, the in-feed container load assembly 40 will place the container in a position for inspection of two sides of the container, after which it will be rotated to permit inspection of the other two sides of such containers.

Further inspections may be provided at a subsequent indexed inspection station 106, including, for example: fill level inspection using a visual inspection system in transparent or semi-transparent containers; cap seal inspection using a pressure test (which may also be performed before the container is placed on the rotary dial plate, as discussed below); bar code inspection using a vision system and/or laser reader system; metal contaminants inspection using a magnetic inspection system; and weight inspection. The number of specific inspections to be employed will depend on the specific product in the containers. Depending on the number of desired inspections, there may be fewer or more platforms and stations. In such an embodiment, after all the inspections are completed, then the centralized multi-container control means 3 will generate a reject message if the container 12 fails any of the tests, which will cause the escapement assembly 700 to send the container 12 to the reject outlet 82.

It is to be appreciated that the inspection functions may be implemented at separate stations as described above, or that more than one function can occur at any one station. However, for convenience of servicing and to obtain a higher throughput, a single inspection function per station is preferred.

Adjustable Rotating Escapement Assembly

As shown in FIGS. 2, 4 and 6, the adjustable rotating escapement assembly 700 takes containers from the indexed escapement station 108 and provides them either back to the conveyor 150 at a conveyor position 72 or to a rejection outlet 82. The adjustable rotating escapement assembly 700 is shown in FIG. 2, and shown in greater detail in FIGS. 7–8.

Figure 7:
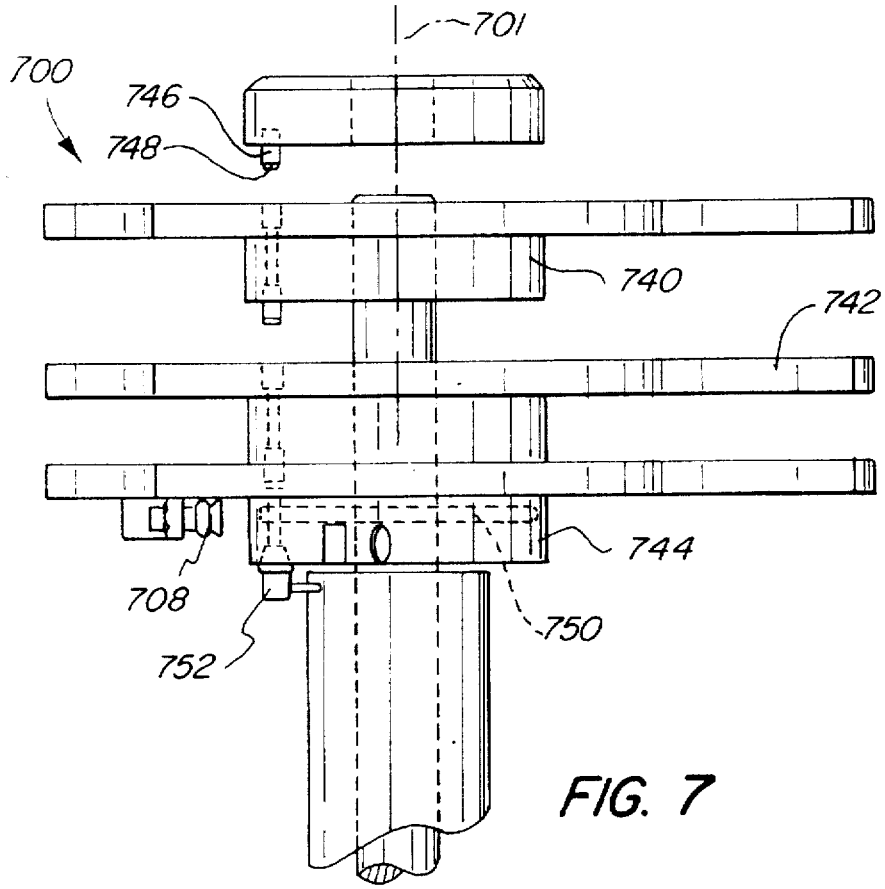
FIG. 7 is a side view of stackable escapement plates of the escapement assembly in FIG. 6.

As shown in FIG. 7, the adjustable rotating escapement assembly 700 is manually adjustable depending on the size of the container, and includes one or more stackable escapement plates 740, 742, 744 arranged on a central axis 701 for adjusting the height thereof depending on the height of the container being inspected. The stackable escapement plates 740, 742, 744 each have a vacuum pin 746 and an O-ring 748. A roll pin 750 and a vacuum hose fitting 752 are also shown.

As shown in FIG. 8, each of the stackable escapement plates 740, 742, 7844 is star shaped, has three escapement arms 702, 704 and 706, and has a vacuum assembly means for providing vacuum to each escapement arm 702, 704 and 706 that includes suction cups 708, vacuum cup mounts 710, vacuum check valves 712, barbed hose fitting 714, tubing 716, swivel elbow barbed hose fitting 718 and drive pins 720. The stackable escapement plates 740, 742, 744 are very similar in design to the plates of the adjustable rotary in-feed assembly 49 shown in FIG. 10 and very similar in design with respect to the vacuum means assembly used thereon.

As shown in FIG. 4, the adjustable rotating escapement assembly 700 has a Browning pulley 760 and a Browning belt 762 for connection to a Browning pulley 764, which is itself connected by linkage to the indexer, motor/reducer, clutch brake means 600. The adjustable rotating escapement assembly 700 also includes an escapement shaft 610, an escape vacuum supply manifold 612, idler arm means 614, an idler bracket 616, a gearbox mount bracket 618.

The adjustable rotating escapement assembly 700 also includes an escapement gate air cylinder mount 770, an air cylinder and rod clevis means 772, a rejection gate shaft 774, ball bearing means 776, a mechanically controlling rejection gate 778.

In operation, the escapement assembly 700 is rotated about in preselected increments so that the escapement plate arms 702, 704, 706 move through a series of at least three predetermined removal positions indicated as 70, 72 and 74 in FIG. 2. At the removal position 70, an escapement plate arm picks up a container 12 from the indexed escapement station 108. If there is no reject message associated with the container 12, the escapement plate arm will be advanced to a first removal position 72 where it releases the container 12 at the accept outlet 80. The container 12 will then continue down the conveyor assembly 150 to be packaged for shipment. If there is a reject message associated with the container 12, the escapement plate arm will advance past the first removal position 72 to a second removal position 74 where it releases the container 12 at reject the outlet 82, where it will be sent down a chute for disposal.

The in-feed container load assembly 40 and the escapement assembly 700 are synchronously driven by the indexer, motor/reducer, clutch brake means 600 which drives the rotary dial plate 22. The operations of the transfer apparatus 40 and outlet transport apparatus are synchronized to the rotation of the rotary dial plate 22. This assures that the rotatable platens 20 of the rotary dial plate 22 will always be in position to receive or discharge a container 12 when the in-feed container load assembly 40 or the escapement assembly 700 is delivering or removing a container 12 from either such position.

The purpose of the reject gate 778 is to act as a secondary assurance that failed containers do not proceed further down the line. The rejection gate 778 has a normal position and an open position, as shown. When the centralized multi-container positioning control means 3 sends a signal for a good container, the rejection gate 778 opens allowing the container to proceed down the line. If a reject signal is received, the reject gate 778 remains closed, as shown. It is only allowed to open after a reject verification is received by the centralized multi-container inspection means 3 from the reject verify eye (not shown). In the inspection device, upon the unloading of a failed container, when a reject verification confirmation signal is sent back to the centralized multi-container control means 3, then the reject gate 778 is allowed to open.

The invention is not intended to be limited to the exact embodiment of the in-feed container load assembly 40 and the escapement assembly 700 described herein. For example, the in-feed container load assembly 40 and the escapement assembly 700 could be altered and still remain within the scope of the invention. For example, either or both the in-feed container load assembly 40 and the escapement assembly 700 could have either a pivoting arm structure as described above for the in-feed container load assembly 40, or either or both could have a rotating arm structure which is similar to that described for the escapement assembly 700. Other devices for transfer of containers 12 such as compressed air jets, swinging arms, and star-wheels could also be used. It would also be possible to provide sufficient stations to the rotary dial plate 22 and appropriate logic controls such that: a container 12 to be rejected is removed directly from the rotary dial plate 22 at a reject station and sent to a reject chute; and an accepted container 12 would be removed from the rotary dial plate 22 at another, preferably subsequent, accept station, and returned to the conveyor line 150 for shipping.

Inspection Means

In the embodiment shown and described, the apparatus includes one or more inspection means 200, 202, 204, 206, 208, etc. for reading various indicia on a label affixed to the container. The inspection means 200, 202, 204, 206, 208, etc. are commercially available by many different suppliers, including Allan-Bradley. The inspection means 200 is used to establish the orientation of the container, as discussed in detail above. In general, the inspection means 202, 204, 206, 208, etc. inspect the container for various indicia and provide a pass or fail signal back to the centralized multi-container control means 3.

In particular, as discussed above, the first inspection means 200 is a UV light sensor or other sensing means for detecting the presence or absence of a UV coated label 14 to orient the container, and the second inspection means 204 is a camera, for example, for reading a lot and expiration indicia on the label 14. A third inspection means may include a second camera for reading RM indicia on the label 14.

The inspection apparatus may be supplied by and are the responsibility of the purchaser of the inspection apparatus. The purpose of the inspection means 200, 202, 204, 206, 208, etc. is to inspect areas of the container or label to assure the correct markings are on the product. As containers are presented in each station, cameras determine whether the markings on the containers pass a comparison test. The line controls include cameras and lighting signals that can be enabled through the centralized multi-container positioning control means 3.

In the embodiment shown and described, the purpose of the UV sensor 200 or other sensing means is to detect the label edge on a container and to control the servo motor 314, so label positioning can occur. The UV sensor 200 is positioned in front of the indexed spin station 102. As the container spins, it looks for the UV coating on the label of the container. When it detects a change of UV from high to low, the inspection information signal is sent to the centralized multi-container acceptance or rejection means. The UV sensor is being activated by the centralized multi-container acceptance or rejection means, and becomes active when the container is rotatably indexed into the station. It becomes inactive upon initiation of the table index.

The inspection means 200, 202, 204, 206, 208, etc. are adjustably arranged on brackets **200*a*, 202*a*, 204*a*, 206*a*, 208*a*. When the apparatus is changed over to inspect other types of indicia on perhaps other types of containers, the inspection device operator must adjust the relative position of the inspection means 200, 202, 204, 206, 208, etc. on the brackets 200*a*, 202*a*, 204*a*, 206*a*, 208*a*** to the location of the indicia information positioned on the label using the video camera means, discussed below.

Video Monitor Display

As shown in FIG. 1, the inspection apparatus may include a video monitor 5 for displaying indicia being viewed on the label by any one of the plurality of inspection means for adjusting the same.

Control Panel

As shown in FIG. 1, the inspection apparatus includes a control panel for operating the container inspection apparatus. The control panel includes a main power on/off switch for turning on/off the container inspection apparatus, a start button for starting the container inspection apparatus, a stop button for stopping the container inspection apparatus, a conveyor on/off button for starting and stopping a conveyor means providing the containers for inspection, a vacuum generator on/off button for starting and stopping a vacuum generator for providing vacuum, a machine jog button for providing a jog mode, an emergency stop button for turning off the container inspection apparatus in an emergency, an alarm buzzer to indicate an alarm, an alarm acknowledgement button for muting the alarm buzzer, and a reset button for resetting the container inspection apparatus to clear faults.

Low Level Sensor

The apparatus may also include a low level proximity sensor **41*a* in FIG. 2** for determining if an adequate queue of containers is being fed to the container inspection apparatus.

The purpose of the low level sensor **41*a* is to determine if an adequate queue on the in-feed conveyor is present to assist in the nesting of containers into the load arm. When the proximity sensor 41*a*** senses a container for a preset time, it is assumed that the queue of containers has reached this point. If the eye stays unblocked for a preset time, the queue has gone below the minimum level.

Cap Presence Sensor

The apparatus may also include a cap presence sensor **41*b* as shown in FIG. 2 to assure that a container is entering the indexed multi-container positioning means 2**.

The purpose of the cap presence sensor **41*b* is to assure that a container entering the rotating dial plate 22 has a cap 12*a*. A convergence eye scans the container top to confirm the presence of the cap 12*a*. A signal is sent to the centralized multi-container inspection control 2. If no cap 12*a*** is detected, the inspection device machine will go into cycle stop, and the containers must be manually removed and the machine reset. The operator interface includes manually removing an uncapped container and resetting the unit, and adjusting a convergence eye height for differing container heights.

Resection Verification

The apparatus may also include a reject verification means to confirm that a rejected container was actually rejected. The reject verification means includes a reject verification eye 90 in FIG. 2 positioned to confirm that a container, which is supposed to be rejected, was actually rejected. For example, a photo reflective eye 90 can be mounted on the reject chute 82 in position to detect a container as it is rejected. When the photo reflective eye 90 is broken by a rejected container, rejection is confirmed. Upon a reject signal from the centralized multi-container control means 2 if the eye is not broken before the next index, the inspection device will go into a cycle stop fault and the reject gate will not be allowed to open. The photo reflective eye 90 must be manually broken before the fault can be cleared. The operator interface includes removing the failed container from the reject gate 778 and break eye beam when a fault occurs. The fault can then be cleared by the reset button.

Centralized Multi-Container Positioning Control

Figure 11:
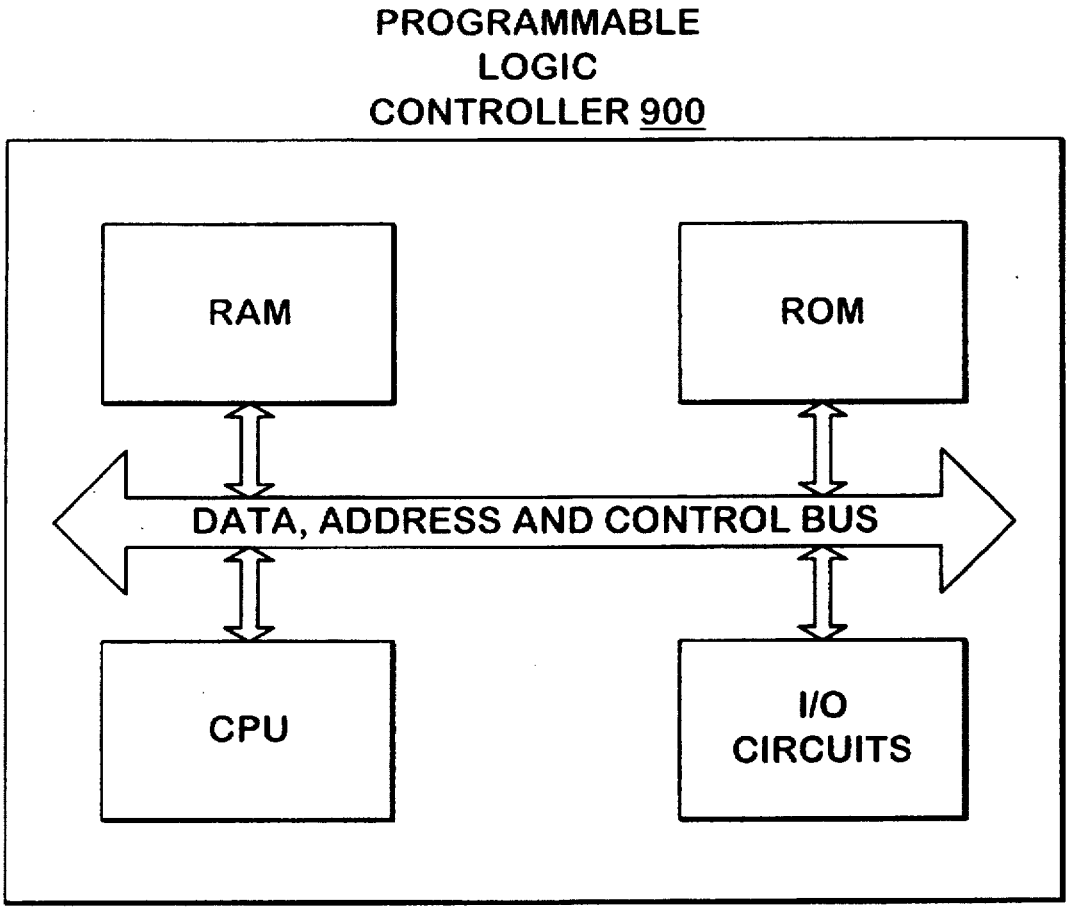
FIG. 11 is a schematic diagram of the Programmable Logic Controller.
Figure 12A:
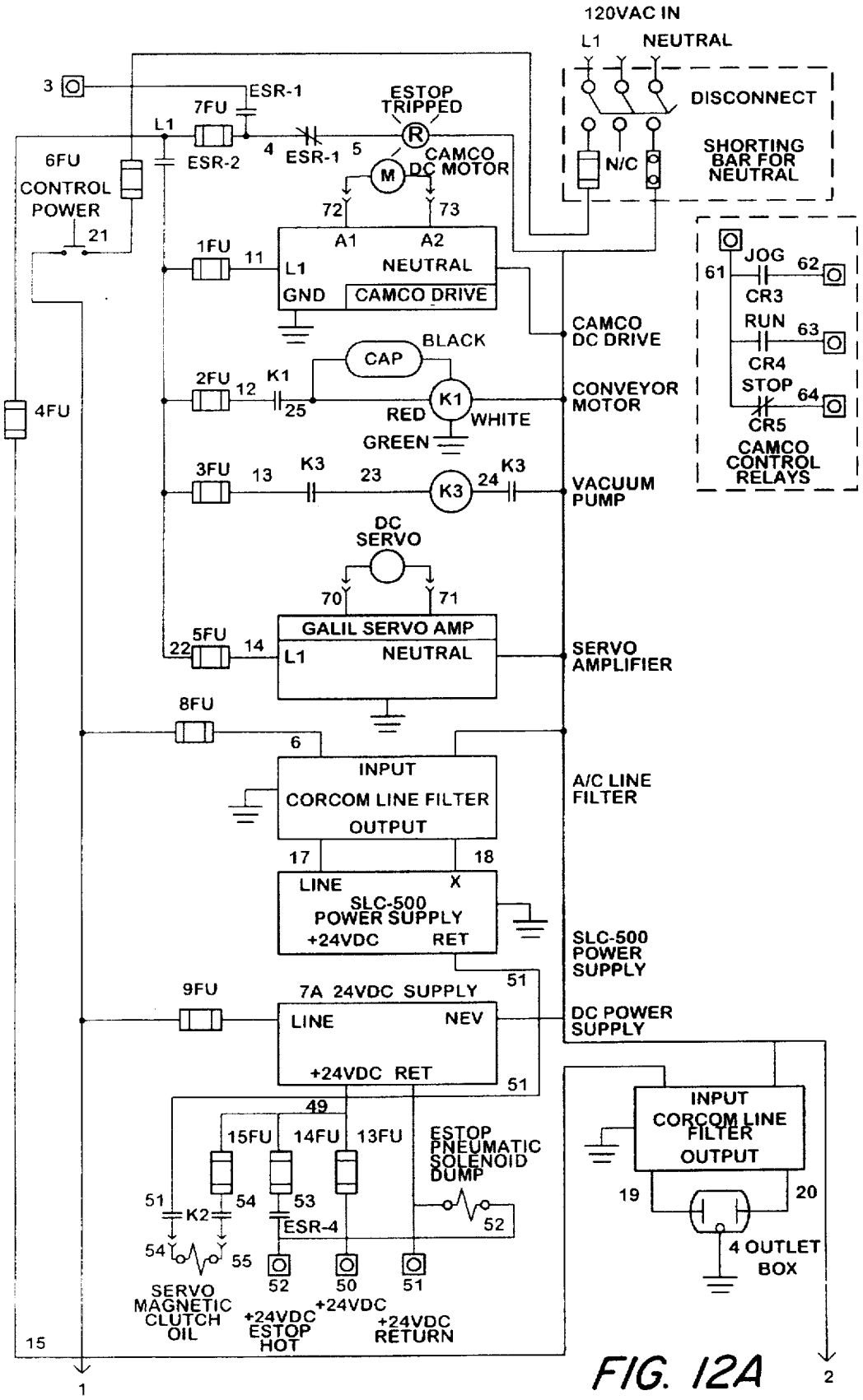
FIG. 12 is a schematic diagram of a main I/O wiring system for the present invention.
Figure 12B:
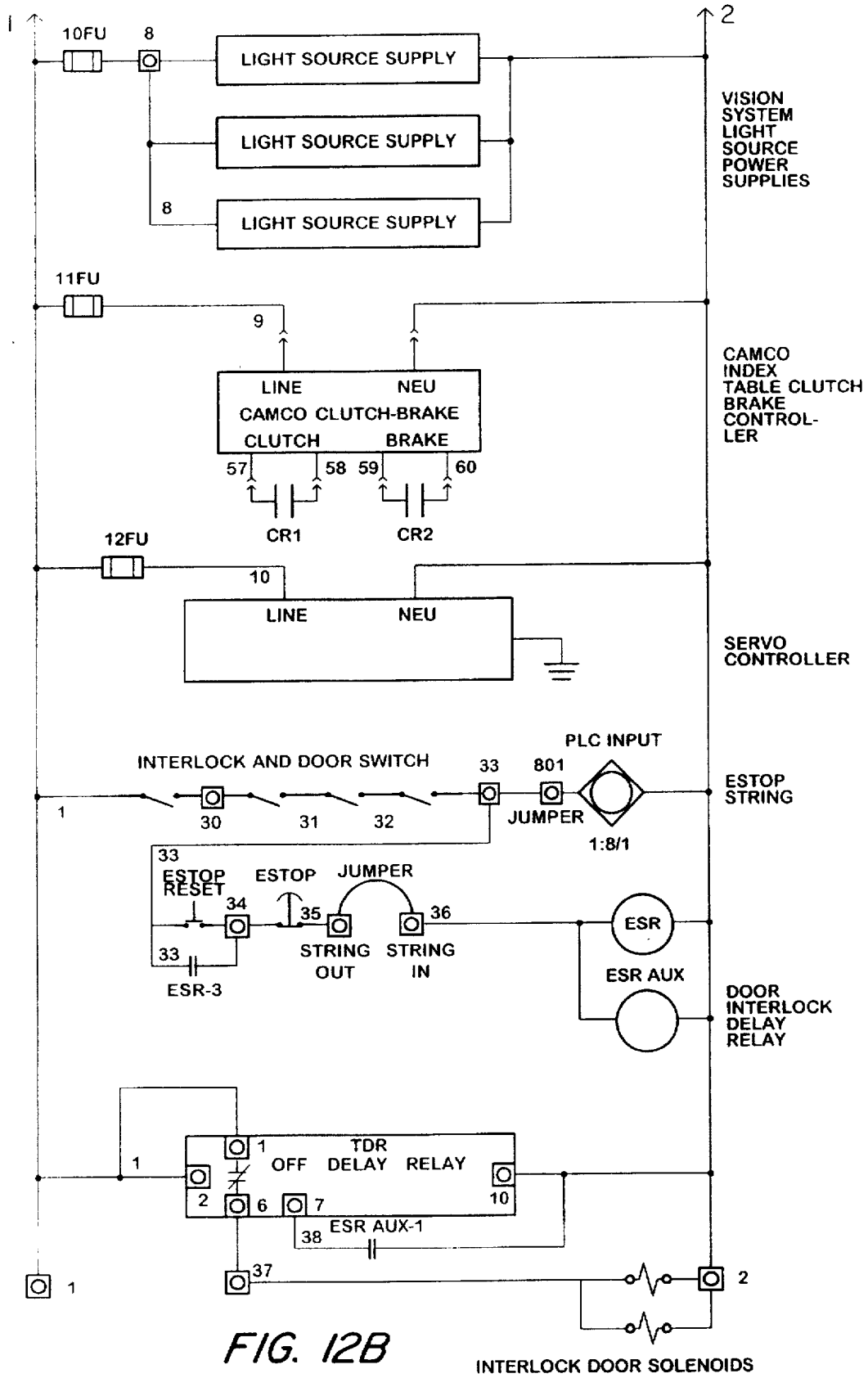
Figure 13A:
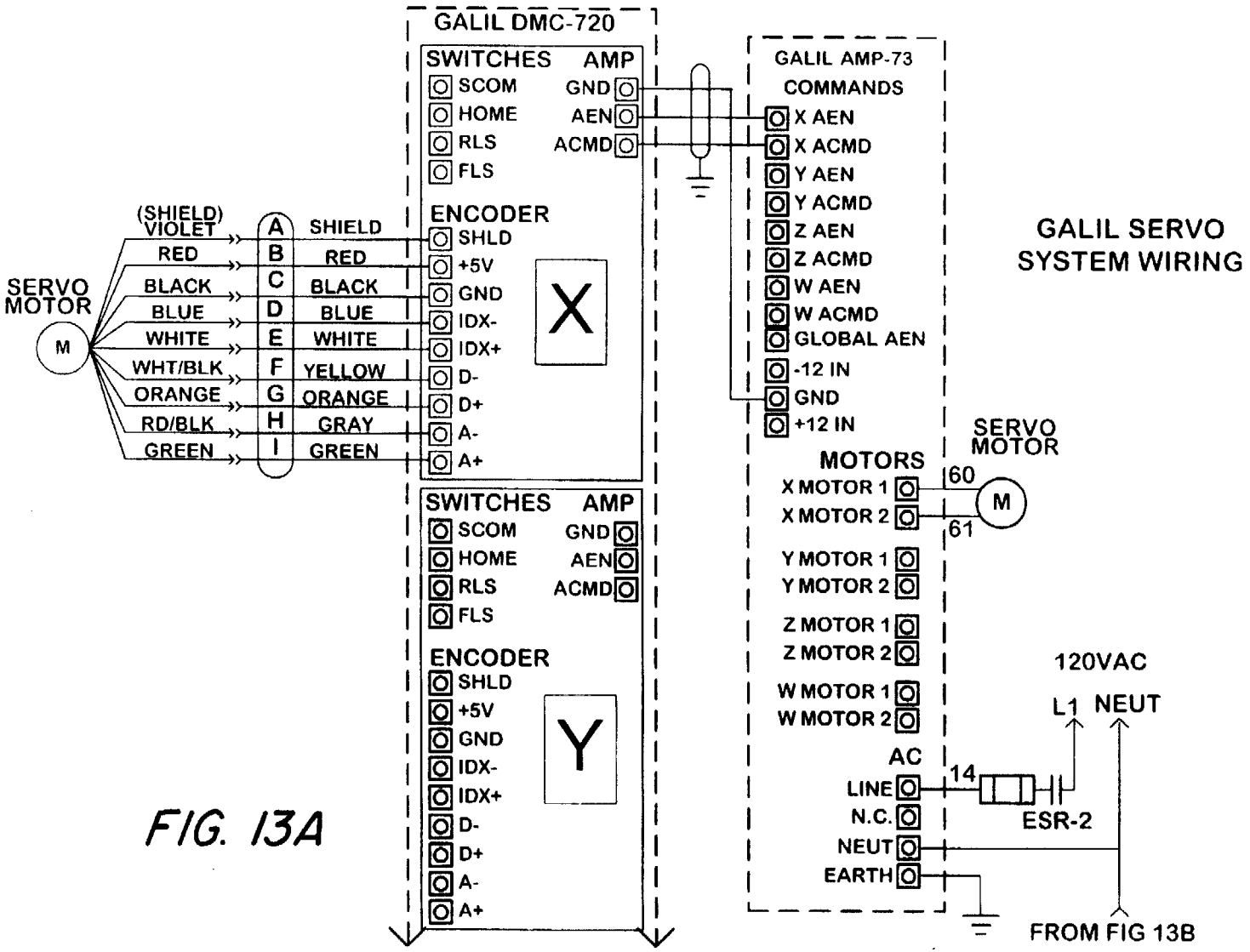
FIG. 13 is a schematic diagram of a Galil servo wiring system for the present invention.
Figure 13B:
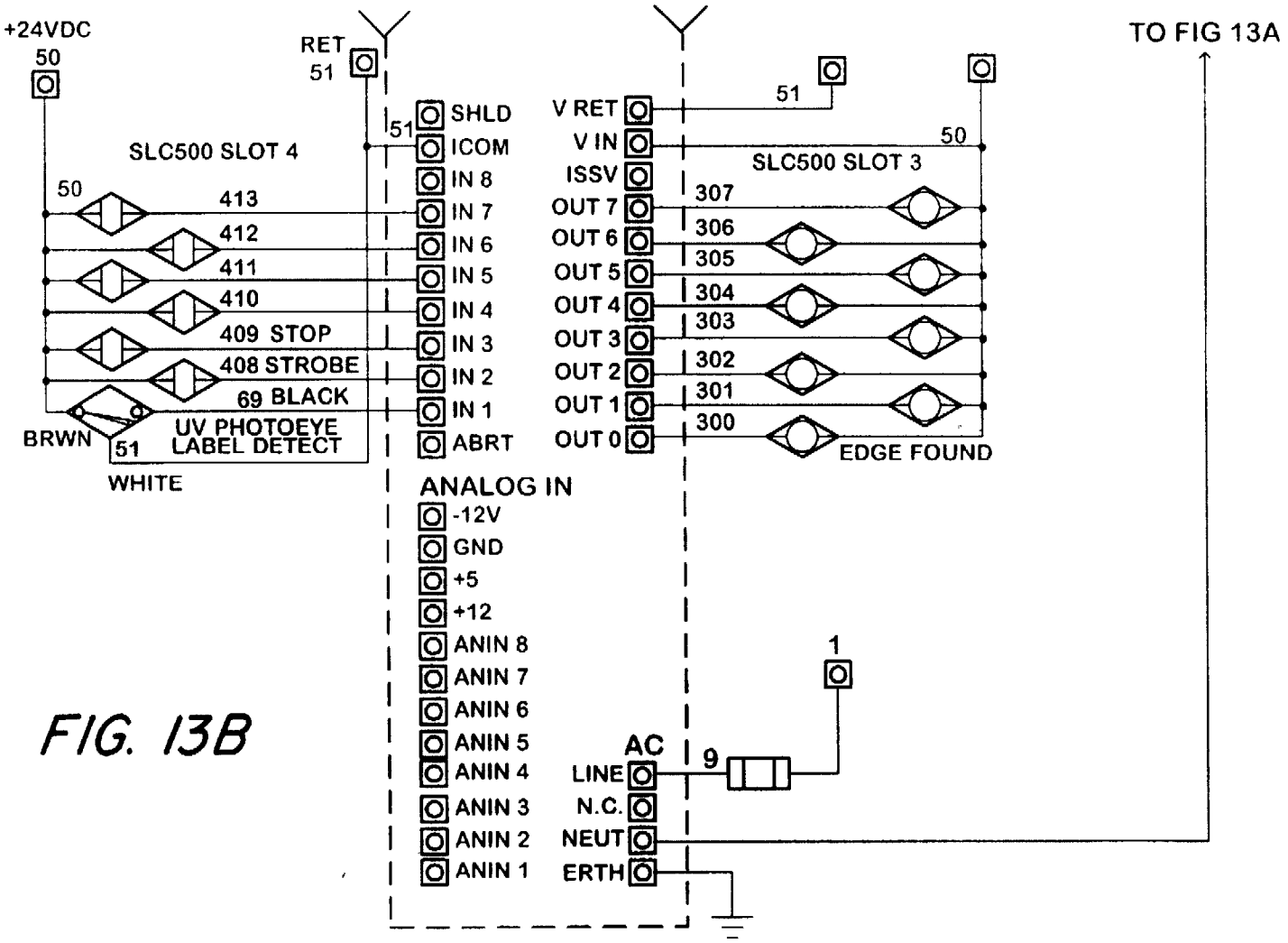
Figure 14:
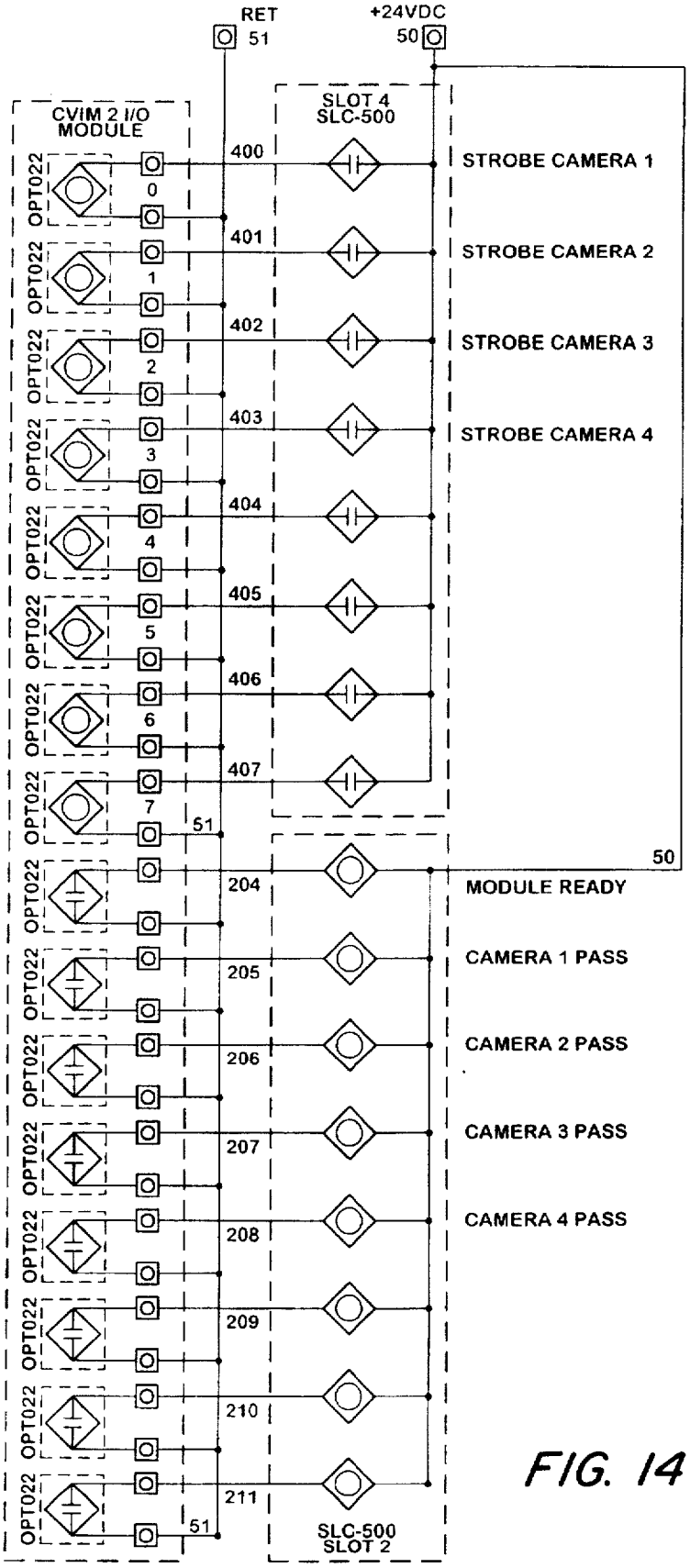
FIG. 14 is a schematic diagram of an Allen Bradley CVIM2 remote wiring system for the present invention.
Figure 15A:
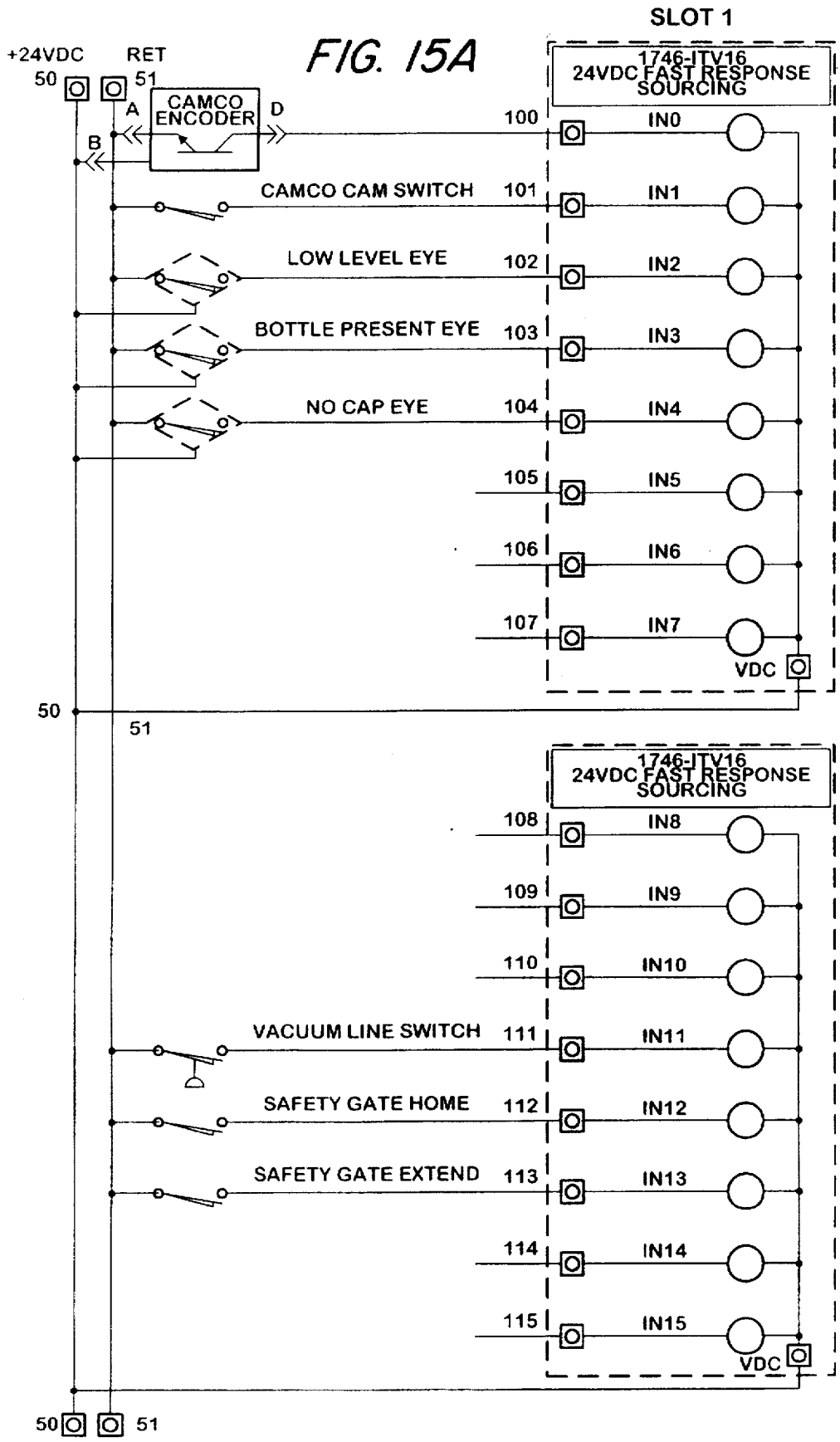
FIG. 15 is a schematic diagram of an Allen Bradley SLC-500 programmable logic control I/O wiring system for slots 1–3 of the present invention.
Figure 15B:
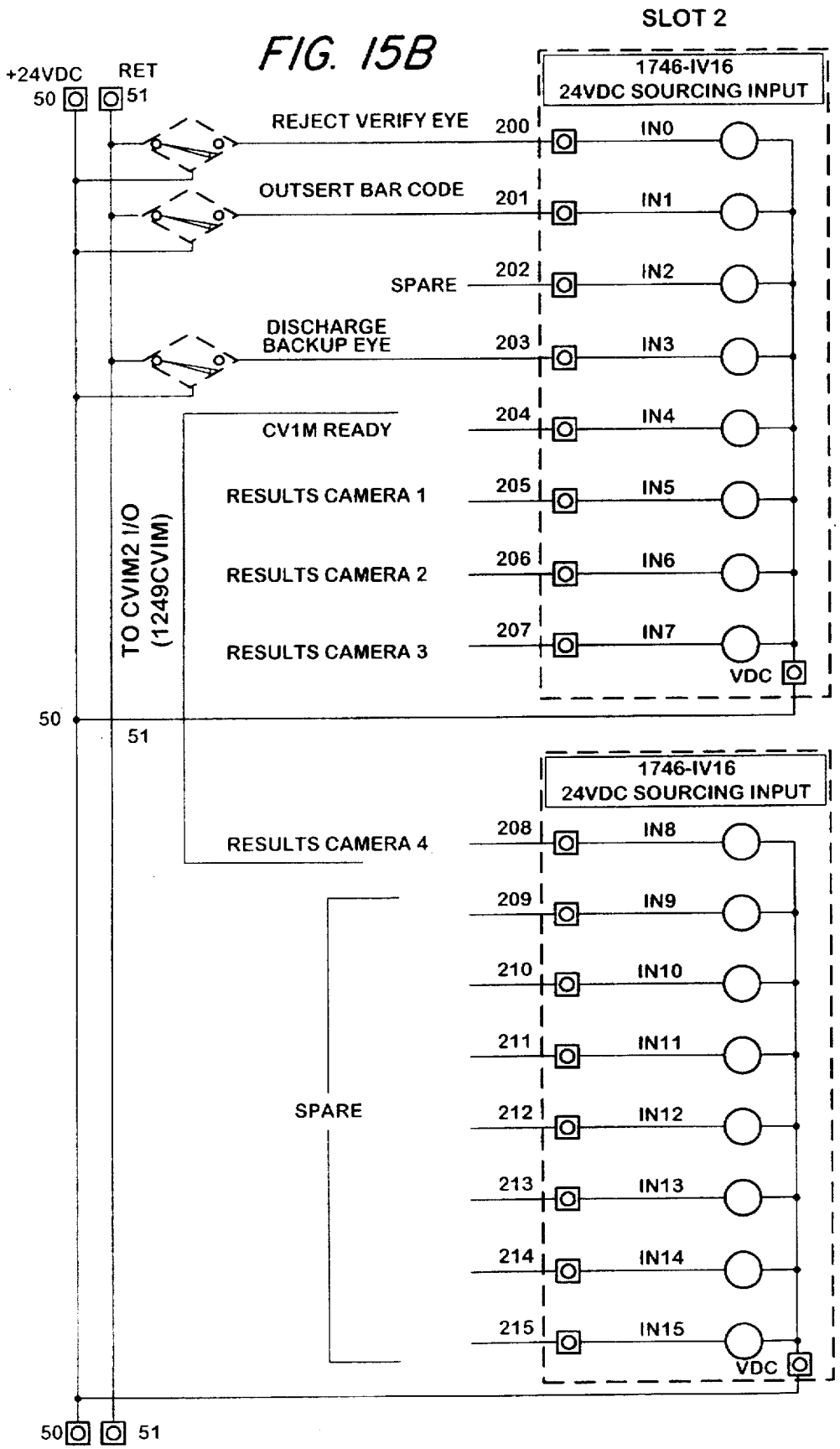
Figure 15C:
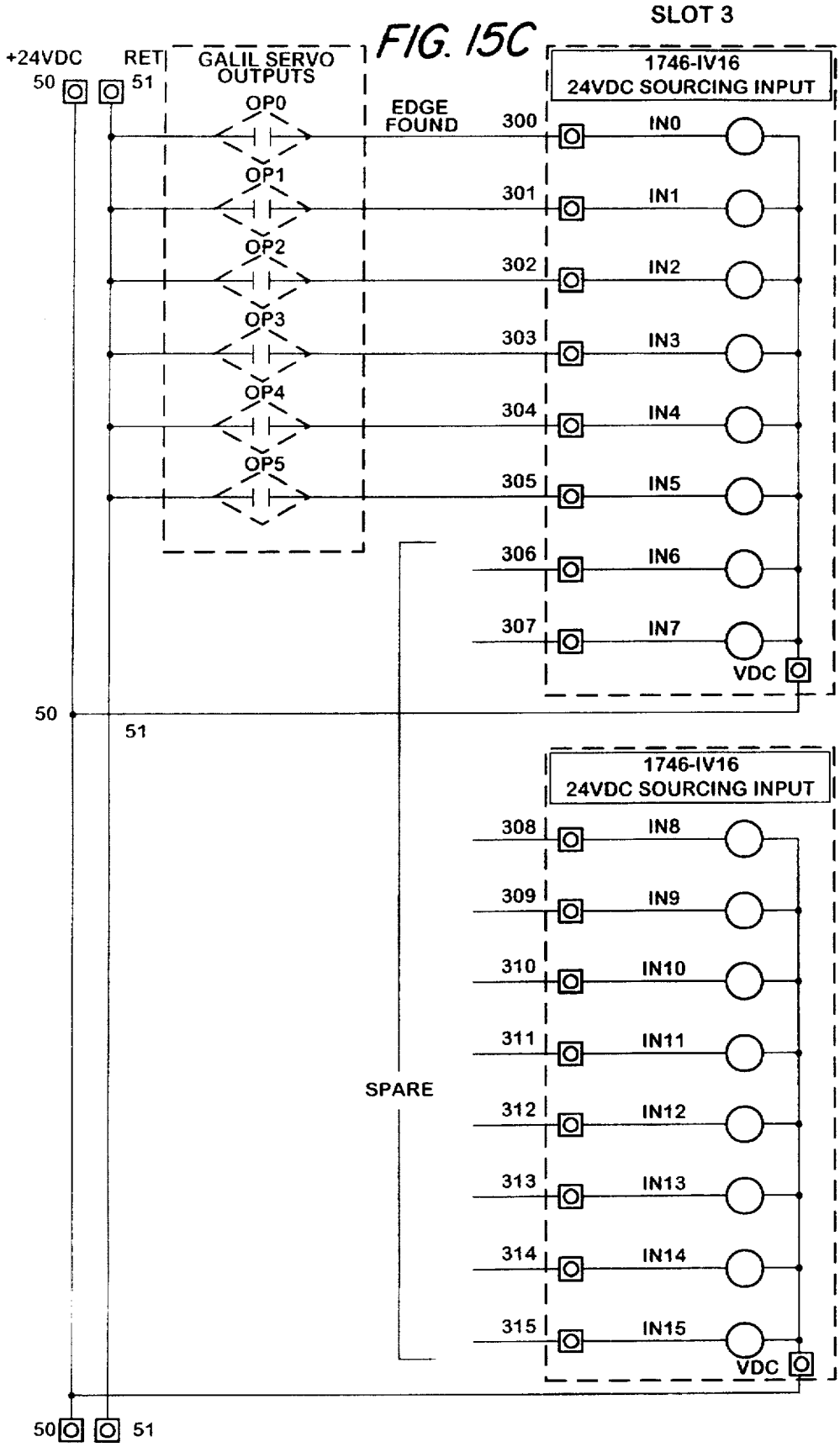
Figure 16A:
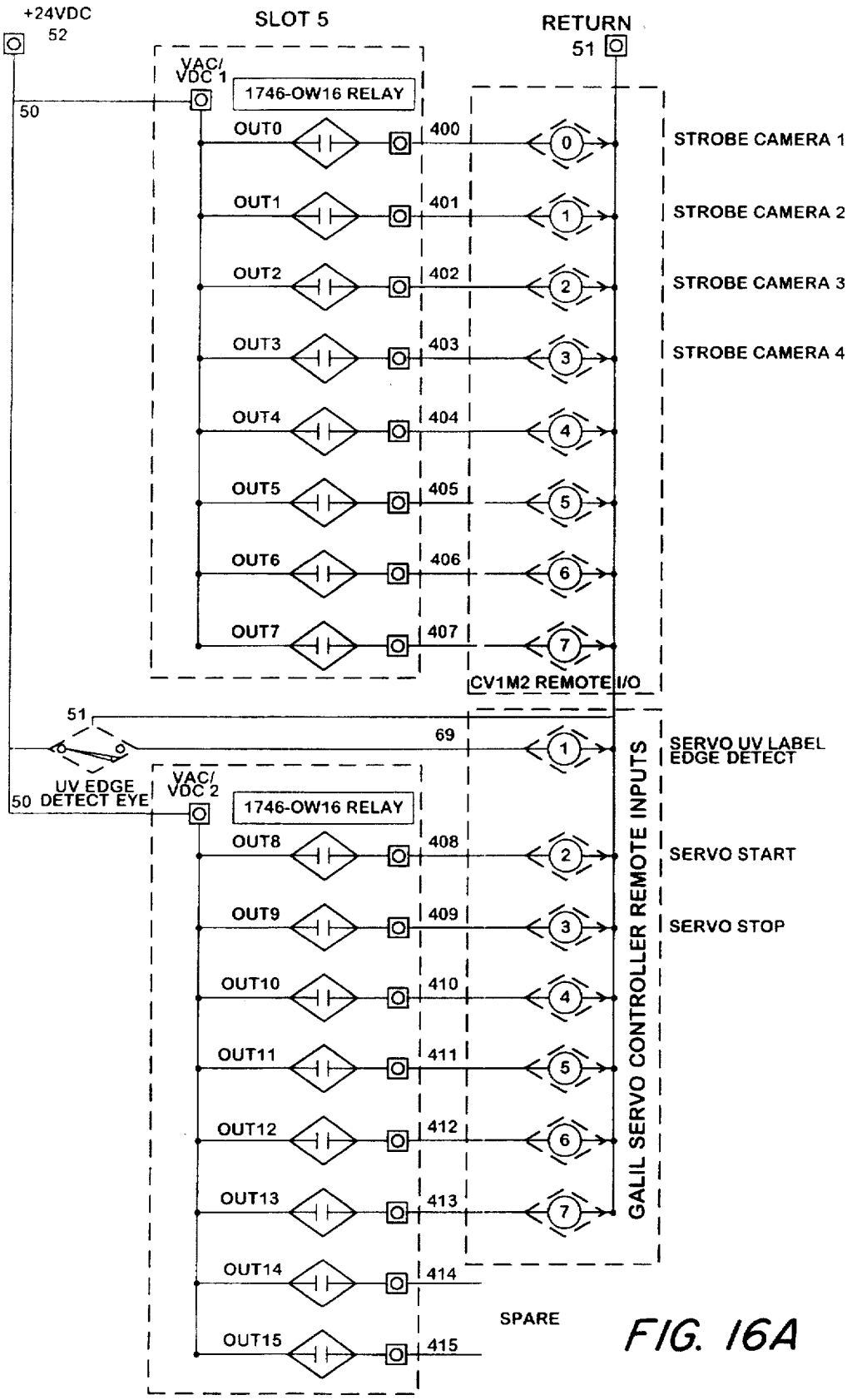
FIG. 16 is a schematic diagram of an Allen Bradley SLC-500 programmable logic control I/O wiring system for slots 4–5 of the present invention.
Figure 16B:
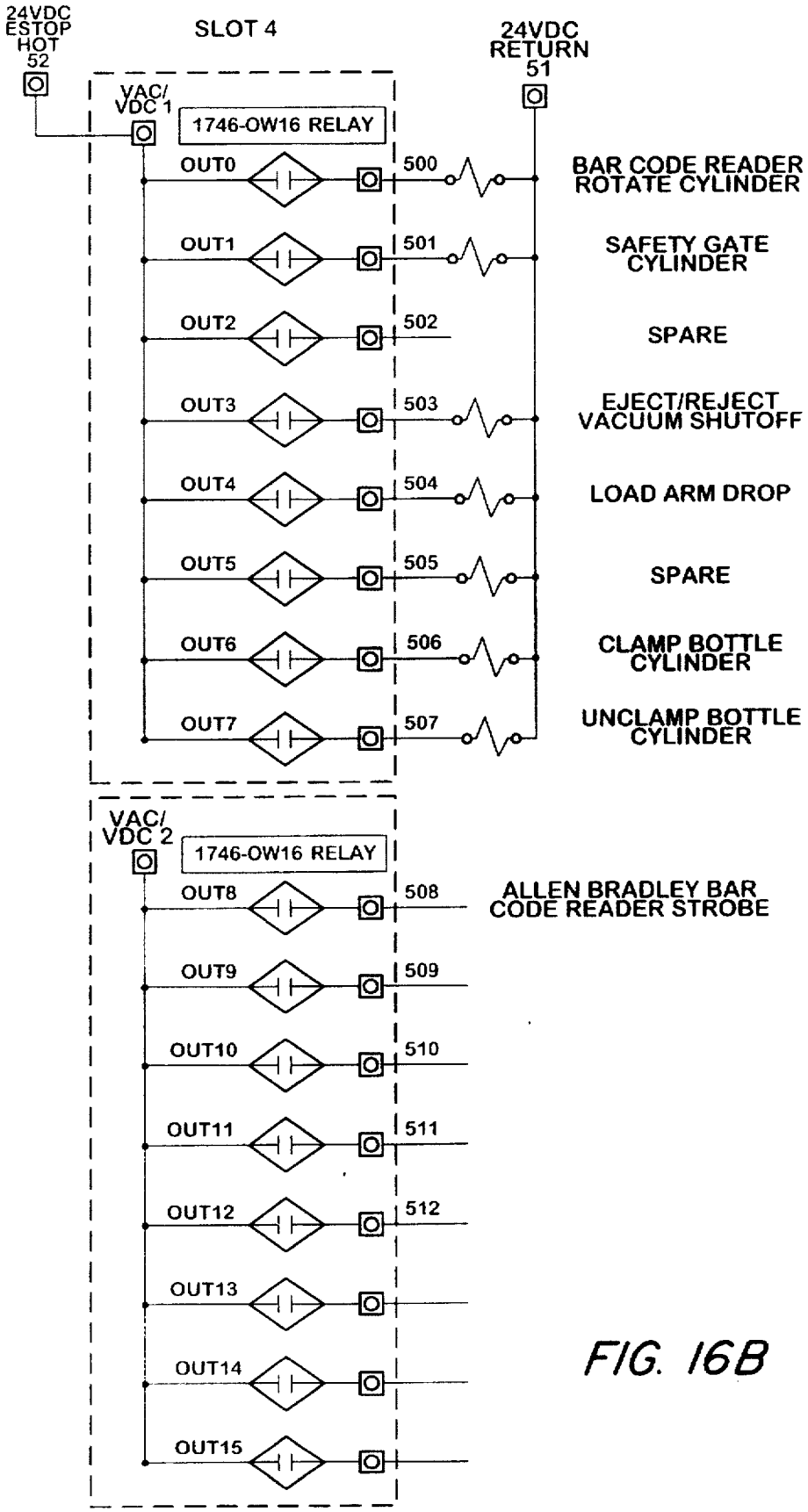
Figure 17A:
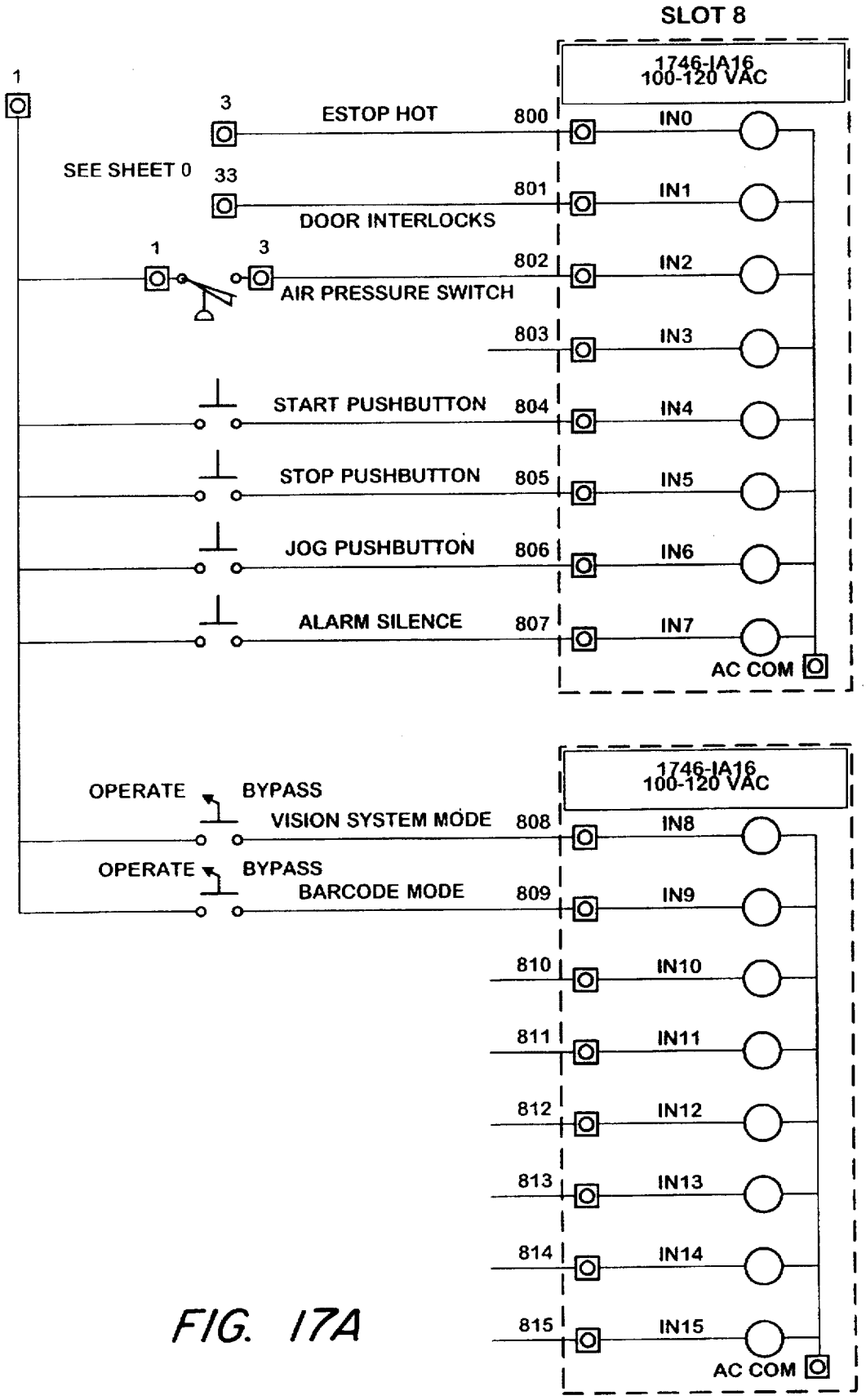
FIG. 17 is a schematic diagram of an Allen Bradley SLC-500 programmable logic control I/O wiring system for slots 8–9 of the present invention.
Figure 17B:
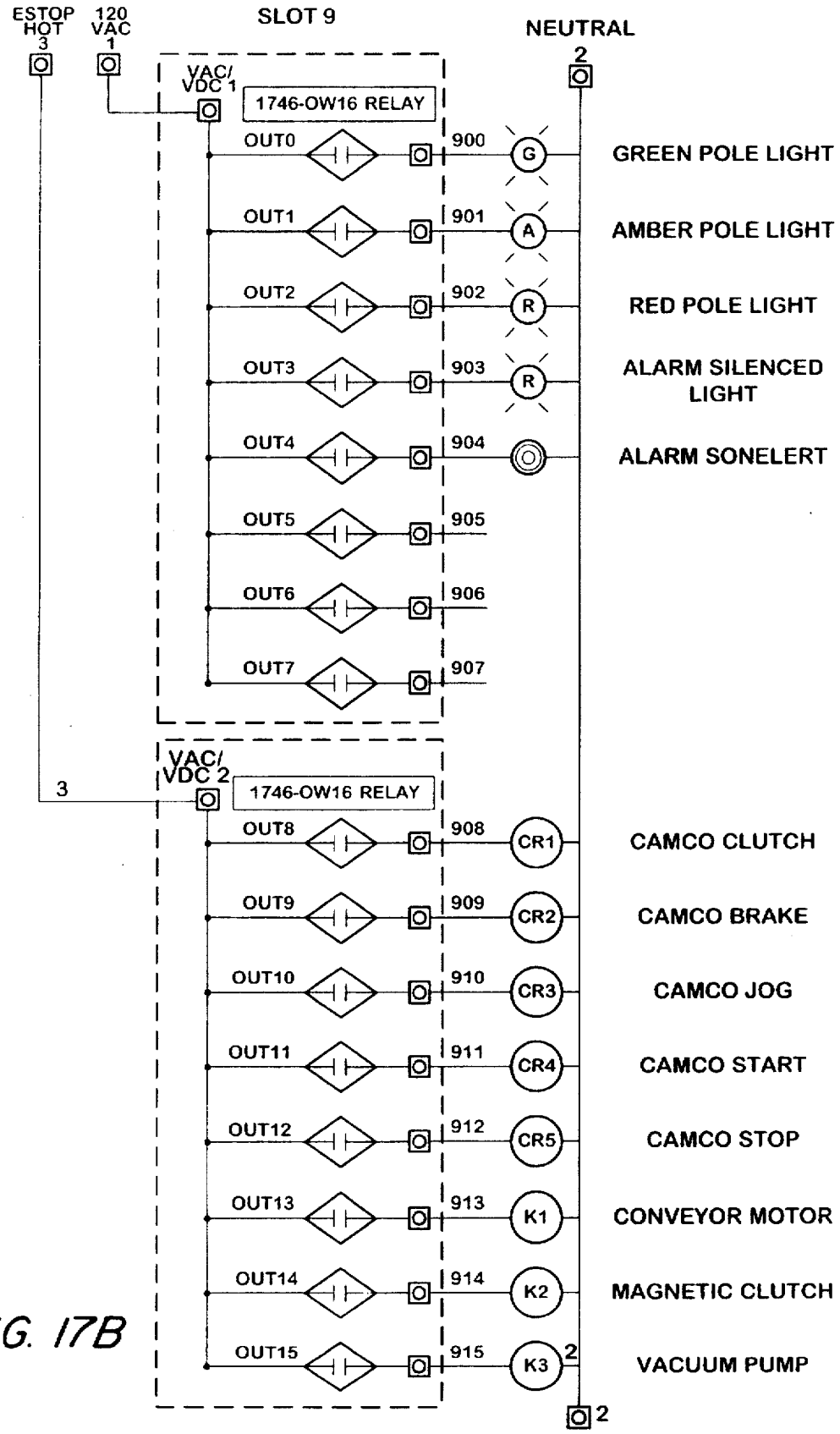

The centralized multi-container positioning control means 3 includes a Programmable Logic Control means, including a Programmable Logic Controller generally indicated as 900 and shown in FIG. 11, and I/O PLC circuits 910 shown in FIGS. 12–17.

FIG. 11 shows the architecture for the Programmable Logic Controller 900, which can be a standard computer having a central processing unit 902, a read only memory 904 (i.e. either ROM or EPROM), a random access memory 906 (RAM), a data, address and control bus 908, an I/O bus 908*a*, and an input/out circuits 918. The read only memory 904 (i.e. either ROM or EPROM) stores a control application program, which is run on the central processing unit 902, for driving the I/O PLC circuits 910 shown in FIGS. 12–17 that are specifically designed for operating the indexed multi-container positioning means 2. The central processing unit 902 provides output control signals on the I/O bus 908*a* for controlling the PLC I/O control circuits 910 shown in FIGS. 12–17. In addition, the central processing unit 902 receives input control signals on the I/O bus from the PLC I/O control circuits 910 shown in FIGS. 12–17. The scope of the invention is not intended to be limited to the specific PLC I/O control circuits shown in FIGS. 12–17.

In one embodiment, the Programmable Logic Controller 900 has a control program which drives the specific PLC I/O control circuits 910 shown in FIGS. 12–17 causing the inspection device to operate, as follows:

1. Containers are fed from the conveyor belt assembly 150 onto the in-feed loader arm assembly 40 of the station conveyor where a queue is allowed to develop.

2. A proximity sensor and a convergency sensor 41 can be used to monitor container queue and height to detect the length of the queue and containers without caps. If a missing cap condition is detected, the inspection machine shuts down until the condition is cleared, and the machine is manually reset by an operator.

3. The forward movement of the first container 12 in the queue is stopped by the load arm 42 where it nestles into a container nesting pocket 43 thereof.

4. A bar code reader (not shown) may be activated to scan the bar code on the outsert on the top 12*a* of the container 12. A signal would be sent to the shift register.

5. The load arm 42 indexes and the container 12 moves into a 1st position on rotary dial plate 22. The back 46 of load arm 42 moves across conveyor assembly 150 to hold back the container queue.

6. A hold down cylinder 332 in position 1 extends a holddown 334 to place pressure on the container cap 12*a*.

7. Vacuum from the cup 44 on the load arm 42 releases.

8. The rotary dial plate 22 indexes to next position. The load arm 42 moves back to accept the next container.

9. An electric clutch on the servo motor 314 engages, and the servo motor ramps up to speed thereby spinning the container 12.

10. An ultraviolet sensor 200 or other optical means monitors the container 12 for the presence or absence of an ultraviolet coated label 14. The container 12 spins until the U.V. sensor 200 detects going from high (presence of U.V. coating) to low (absence of U.V. coating), indicating the trailing edge of the label and sends a signal to the servo motor 314.

11. The servo motor 314 stops when it receives the signal from the U.V. sensor 200.

12. The electric clutch releases.

13. The rotary dial plate 22 indexes to a next position.

14. A camera 1 searches for correct Lot and Expiration # and sends a pass/fail signal to the shift register.

15. The rotary dial plate 22 is indexed to a next indexed position.

16. A camera 2 searches for RM# and sends a pass/fail signal to the shift register.

17. The rotary dial plate 22 is indexed to a next indexed position.

18. The next indexed inspection station is a spare station, as shown in FIGS. 2, 4 and 6.

19. The rotary dial plate 22 is indexed to a next indexed position.

20. A camera searches for label and cap skew and sends a pass/fail signal to the shift register.

21. The rotary dial plate 22 is indexed to a next indexed position, which is an unload position.

22. The holddown 334 of the cylinder 330 retracts.

23. The unload star escapement plate 700 continues into position, contacting the container 12. Vacuum cups 708 are activated upon sensing a container 12.

24. The rotary dial plate 22 is indexed to a next empty position. The unload arm is indexed to the eject position. The safety gate on the outfeed conveyor moves across the conveyor assembly 150 if any inspection on that container 12 has failed.

25. If the container inspections have all passed, vacuum is released on the unload arm, and the container is free to proceed along the outfeed conveyor. Vacuum is released by means of a solenoid activated cylinder cam which moves into position to trip a microswitch controlling the vacuum.

26. The rotary dial plate 22 is indexed to a next load position. The unload arm indexes to the reject position. Vacuum is released by means of a microswitch activated by a mechanical fixed location cam.

27. If any inspections on that container have failed, the container will be in the reject position. Vacuum is released on the unload arm, and the container falls free of the arm.

28. The reject verification eye 90 in FIG. 2 confirms that the part was rejected and sends a signal to the centralized multi-container positioning control means 3.

29. Upon receiving the reject verification signal, the rejection gate 778 (FIG. 6) is opened. If no reject verification signal is received, the rejection gate will remain closed and a cycle stop condition will occur with applicable faults.

The present invention improves over the prior art by providing a direct and positive control of the quality of the inspected goods. This is achieved by having the inspection function and the removal of the container from the line occur during the same operation. It eliminates problems of prior art label inspections where the label is inspected prior to application, but the label and the container 12 to which it is applied are not removed from the line until later in the manufacturing process. It also provides a unique approach to inspection of filled containers.

As those skilled in the art will recognize, the invention is not necessarily limited to the specific embodiments described herein, and the inventive concept may be implemented in additional ways, all in accordance with the claims below.

We claim:

1. An apparatus for inspection of a container having a label applied thereto, comprising:

at least one rotatable platform movable through a plurality of stations;

means for rotation of said platform;

means for stopping rotation of said platform when the container is in a desired position for label inspection; and means for removing the container from said rotatable platform and selectively directing the container to either an accept outlet or a reject outlet.

2. An apparatus in accordance with claim 1, wherein said means for stopping rotation of said platform stops rotation of said platform at a predetermined position relative to an edge of the label upon detection by a vision system of the edge of the label.

3. An apparatus in accordance with claim 1, wherein there are at least four said platforms and further comprising a rotatable table which is movable in preselected increments, said platforms being located in said table whereby said platforms are movable to and held in a series of predetermined stations for a predetermined period of time.

4. An apparatus in accordance with claim 1, wherein said means for rotation of said platform comprises a servo motor, wherein said platform is coupled to said servo motor by a magnetic clutch when said platform is located at one of said plurality of stations.

5. An apparatus in accordance with claim 1, wherein said apparatus further comprises means for placing the container on said rotatable platform having a loading arm having means for gripping the container, said loading arm being pivotally movable between a container receiving position and a container delivering position, said container delivering position being located at a container delivering station of said plurality of stations, and said receiving position being located at a container receiving station of said plurality of stations.

6. An apparatus in accordance with claim 5, wherein said gripping means in said loading arm comprises a vacuum cup, and wherein said loading arm container receiving position is positioned on a conveyor, and said loading arm is provided with a container blocking flange to prevent advance of containers on said conveyor when said loading arm is in said container delivering position.

7. An apparatus in accordance with claim 1, wherein said means for removing the container from said rotatable platform comprises a rotating transport apparatus having three arms extending from a central axis; said arms each being provided with means for gripping the container; said transport apparatus being rotatable in preselected increments about said axis whereby said arms are movable through a series of at least three predetermined removal stations, including a removal station for removing the container from said platform when said platform is located at a container removal station of said plurality of stations, a removal station for an outlet for rejected containers, and a removal station for an outlet for containers which are not rejected.

8. An apparatus in accordance with claim 1, further comprising a holddown located above said platform, said holddown being movable between a retracted position and a clamping position to hold the container on said platform.

9. An apparatus in accordance with claim 8, wherein said holddown comprises a pneumatically actuated piston located above said platform and having a clamping surface for engaging an upper end of the container.

10. An apparatus in accordance with claim 1, further comprising a machine vision label inspection system for viewing the label affixed to the container when the container is at said desired position; and means for comparing an image obtained by said machine vision inspection system with established criteria to determine if the label meets predetermined standards for the label and to cause said means for removing said container from said rotatable platform and selectively directing the container to said reject outlet if said label does not match the predetermined standards for the label.

11. An apparatus in accordance with claim 10, in which said viewing of the label by said machine vision label inspection system occurs at an inspection station of said plurality of stations.

12. A method of inspecting a label applied to a container, comprising the steps of:

placing the container on a rotatable platform;

rotating said platform;

detecting an edge of said label as said container rotates on said rotating platform;

stopping rotation of said platform at a predetermined position relative to the position of the detected edge of the label;

advancing the container to a label inspection station;

viewing the label using a machine vision label inspection system;

comparing an image obtained by said machine vision inspection system with established criteria to determine if the label meets predetermined standards for the label; and selectively directing the container to a reject outlet if said label does not match the predetermined standards for the label.

13. A method according to claim 12, wherein the method further comprises the step of advancing the container to an edge detection station.

* * * * *

UNITED STATES PATENT AND TRADEMARK OFFICE

CERTIFICATE OF CORRECTION

PATENT NO. : 5,755,335
DATED : May 26, 1998
INVENTOR(S) : Michelotti et al.

It is certified that error appears in the above-identified patent and that said Letters Patent is hereby corrected as shown below:

Column 10, line 18 "7844" should read --744--

Signed and Sealed this
Twelfth Day of January, 1999

*Attest:*

*Attesting Officer*

*Acting Commissioner of Patents and Trademarks*